US011498303B2

(12) United States Patent
Cheich et al.

(10) Patent No.: US 11,498,303 B2
(45) Date of Patent: Nov. 15, 2022

(54) VOID-FILL DUNNAGE CONVERSION MACHINE, STOCK MATERIAL SUPPORT, AND METHOD

(71) Applicant: Ranpak Corp., Concord Township, OH (US)

(72) Inventors: Robert C. Cheich, Independence, OH (US); David V. Murphy, Painesville, OH (US); Steven M. Toneff, Painesville, OH (US); Jacob G. Popek, Grosse Pointe Park, MI (US); Carrie Schlegal, Ashtabula, OH (US)

(73) Assignee: Ranpak Corp., Concord Township, OH (US)

( * ) Notice: Subject to any disclaimer, the term of this patent is extended or adjusted under 35 U.S.C. 154(b) by 690 days.

(21) Appl. No.: 15/077,549

(22) Filed: Mar. 22, 2016

(65) Prior Publication Data

US 2016/0200065 A1 Jul. 14, 2016

Related U.S. Application Data

(62) Division of application No. 13/574,305, filed as application No. PCT/US2011/020477 on Jan. 7, 2011, now Pat. No. 9,321,235.

(Continued)

(51) Int. Cl.
*B31D 5/00* (2017.01)

(52) U.S. Cl.
CPC ..... *B31D 5/0043* (2013.01); *B31D 5/0047* (2013.01); *B31D 2205/0035* (2013.01);

(Continued)

(58) Field of Classification Search
CPC ..... B31D 5/0043; B31D 5/0047; B31D 2205/0035; B31D 2205/0047; B31D 2205/0076; B31D 2205/0082

(Continued)

(56) References Cited

U.S. PATENT DOCUMENTS 2,135,814 A * 11/1938 Hearn ..... B42F 7/10 206/449
2,779,450 A * 1/1957 Mecum ..... B65H 45/1015 400/613.2

(Continued)

FOREIGN PATENT DOCUMENTS

EP 2204325 A1 * 7/2010 ..... B31D 5/0047
FR 2 798 981 3/2001
WO 2009/126838 10/2009

OTHER PUBLICATIONS

International Search Report and Written Opinion of corresponding International Application No. PCT/US2011/020477, dated Dec. 30, 2011.

*Primary Examiner* — Sameh Tawfik
(74) *Attorney, Agent, or Firm* — Renneer, Otto, Boisselle & Sklar, LLP

(57) ABSTRACT

A machine for converting a sheet stock material into a dunnage product includes a conversion assembly for converting sheet stock material into a dunnage product as the sheet stock material travels along a path from an upstream end of the conversion assembly to a downstream end of the conversion assembly. The machine further includes a transversely extending guide over which the stock material passes for guided entry into the upstream end of the conversion assembly. The guide is rotatable such that the transverse extent of the guide can be moved between a plurality of relatively rotated orientations to guide the sheet stock material from different sides of the conversion assembly.

14 Claims, 23 Drawing Sheets

Related U.S. Application Data

(60) Provisional application No. 61/304,533, filed on Feb. 15, 2010.

(52) U.S. Cl.
CPC ..... *B31D 2205/0047* (2013.01); *B31D 2205/0076* (2013.01); *B31D 2205/0082* (2013.01)

(58) Field of Classification Search
USPC ..... 493/464, 350, 352, 967
See application file for complete search history.

(56) References Cited

U.S. PATENT DOCUMENTS 2,806,591 A * 9/1957 Appleton ..... A47K 10/22 225/106
4,237,776 A 12/1980 Ottaviano
4,525,087 A * 6/1985 Cardona ..... B41J 15/16 400/613.2
4,557,716 A 12/1985 Ottaviano
4,627,319 A 12/1986 Mattei et al.
4,717,613 A 1/1988 Ottaviano
5,123,889 A 6/1992 Armington et al.
5,123,893 A * 6/1992 Grooms ..... B65H 45/1015 493/410
5,203,761 A * 4/1993 Reichental ..... B26D 1/185 493/346
5,238,316 A * 8/1993 Moore ..... A47B 31/00 400/613
5,316,231 A 5/1994 Thievessen et al.
5,481,817 A * 1/1996 Parker ..... F41A 23/02 248/286.1
5,513,921 A * 5/1996 Alcoran ..... B41J 15/04 400/599.1
5,630,526 A * 5/1997 Moody ..... A47K 10/16 221/45
5,642,951 A * 7/1997 Belizario ..... B41J 11/58 400/613.2
5,803,893 A 9/1998 Armington et al.
6,095,347 A * 8/2000 Mauro-Vetter ..... B65G 1/08 211/151
6,123,208 A * 9/2000 Haenszel ..... A47B 45/00 108/55.1
6,471,206 B1 * 10/2002 Spina ..... B65H 31/20 271/171
6,536,760 B1 * 3/2003 Spina ..... B65H 31/20 271/169
6,676,589 B2 1/2004 Kung et al.
7,614,994 B2 * 11/2009 Harding ..... B31D 5/0047 493/352
7,858,268 B2 * 12/2010 David ..... G03F 7/70283 359/569
10,093,070 B2 * 10/2018 Lintala ..... B31D 5/0047
2008/0076654 A1 3/2008 Riga et al.
2008/0098699 A1 5/2008 Cheich et al.

* cited by examiner

VOID-FILL DUNNAGE CONVERSION MACHINE, STOCK MATERIAL SUPPORT, AND METHOD

This application is a divisional of U.S. patent application Ser. No. 13/574,305 filed on Jul. 20, 2012; which is a national phase application of International Patent Application No. PCT/US2011/020477, filed Jan. 7, 2011, and published in English as WO 2011/100078 A2, on Aug. 18, 2011; which claims the benefit of U.S. Provisional Patent Application No. 61/304,533, filed Feb. 15, 2010; each of which is hereby incorporated herein by reference in its entirety.

FIELD OF THE INVENTION

Our invention relates to the field of dunnage conversion machines, which convert a stock material into a dunnage product, and more particularly to dunnage conversion machines that produce a void-fill dunnage product, a corresponding method for producing dunnage, and a support for a supply of stock material.

BACKGROUND

Dunnage conversion machines convert a stock material into a dunnage product that can be used to pack articles and thus minimize or prevent damage during shipment. The dunnage conversion machines, also referred to as dunnage converters, include a conversion mechanism that converts a stock material into a relatively thicker and lower density dunnage product as the stock material moves through the conversion mechanism from an upstream end toward an outlet at a downstream end.

An exemplary type of dunnage conversion machine converts a sheet stock material, such as paper, into a dunnage product. Typically a substantially continuous sheet material is inwardly and longitudinally crumpled, and fixed in its crumpled state. Exemplary dunnage conversion machines of this type are disclosed in U.S. Pat. Nos. 4,717,613; 5,123,889; and 5,803,893.

SUMMARY

Our invention provides several features that alone or in combination improve on a void-fill dunnage conversion machine. These features include (i) a rotatable constant-entry guide that facilitates feeding a sheet stock material into a conversion assembly from multiple directions; (ii) a housing that more completely encloses the conversion assembly for quieter operation, the housing providing access to the conversion assembly therein via one or more access doors; (iii) a linkage mechanism that allows the conversion assembly to be cantilevered over a work surface at a packing station and allows the conversion assembly to be raised and lowered without changing the orientation of the outlet; and (iv) a cart or stand for a supply of fan-folded sheet stock material, the cart or stand having lateral supports that move relative to one another to adapt to receive and support different widths of sheet stock material.

More particularly, our invention provides a machine for converting a sheet stock material into a dunnage product. The machine includes a conversion assembly for converting sheet stock material into a dunnage product as the sheet stock material travels along a path from an upstream end of the conversion assembly to a downstream end of the conversion assembly. The machine further includes a transversely extending guide over which the stock material passes for guided entry into the upstream end of the conversion assembly. The guide is rotatable such that the transverse extent of the guide can be moved between a plurality of relatively rotated orientations to guide the sheet stock material from different sides of the conversion assembly.

Our invention also provides a dunnage conversion machine that converts a sheet stock material into a dunnage product, where again the machine includes a conversion assembly for converting sheet stock material into a dunnage product as the stock material travels from an upstream end of the conversion assembly to a downstream end of the conversion assembly. The conversion assembly includes a movable member to engage the stock material and move it through the conversion assembly during the conversion process. The machine also includes a guide upstream of the conversion assembly to guide stock material to the upstream end of the conversion assembly, and a housing that encloses a space from the guide to the upstream end of the conversion assembly and the movable member in the conversion assembly. The housing includes at least one door that is openable to access the upstream end of the conversion assembly.

Our invention also provides a dunnage conversion machine with a conversion assembly for converting sheet stock material into a dunnage product as the stock material travels from an upstream end of the conversion assembly to a downstream end of the conversion assembly, and a parallel linkage assembly mounted to the conversion assembly that allows the conversion assembly to be moved relative to a support to which the linkage assembly is mountable without changing the orientation of the conversion assembly.

Our invention also provides a device for supporting a stack of sheet stock material for conversion into a dunnage product. This device includes a horizontal support surface and a pair of laterally-spaced upright support members. At least one of the support members is laterally adjustable relative to the other support member to accommodate different widths of stock material.

Alternatively, our invention also provides a device for supporting multiple stacks of sheet stock material for conversion into a dunnage product. This device includes a base support surface and at least three walls extending from and perpendicular to the base to define at least two compartments for supporting a stack of sheet stock material in each compartment.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

Our invention provides several features that alone or in combination improve on a void-fill dunnage conversion machine. These features include (i) a rotatable constant-entry guide that facilitates feeding a sheet stock material into a conversion assembly from multiple directions; (ii) a housing that more completely encloses the conversion assembly for quieter operation, the housing providing access to the conversion assembly therein via one or more access doors; (iii) a linkage mechanism that allows the conversion assembly to be cantilevered over a work surface at a packing station and allows the conversion assembly to be raised and lowered without changing the orientation of the outlet; and (iv) a cart or stand for a supply of fan-folded sheet stock material, the cart or stand having lateral supports that move relative to one another to adapt to receive and support different widths of sheet stock material. The dunnage product produced from the stock material is not limited and can include air bags, paper pads, paper void-fill, a peanut-like pourable dunnage, etc.

Figure 1:
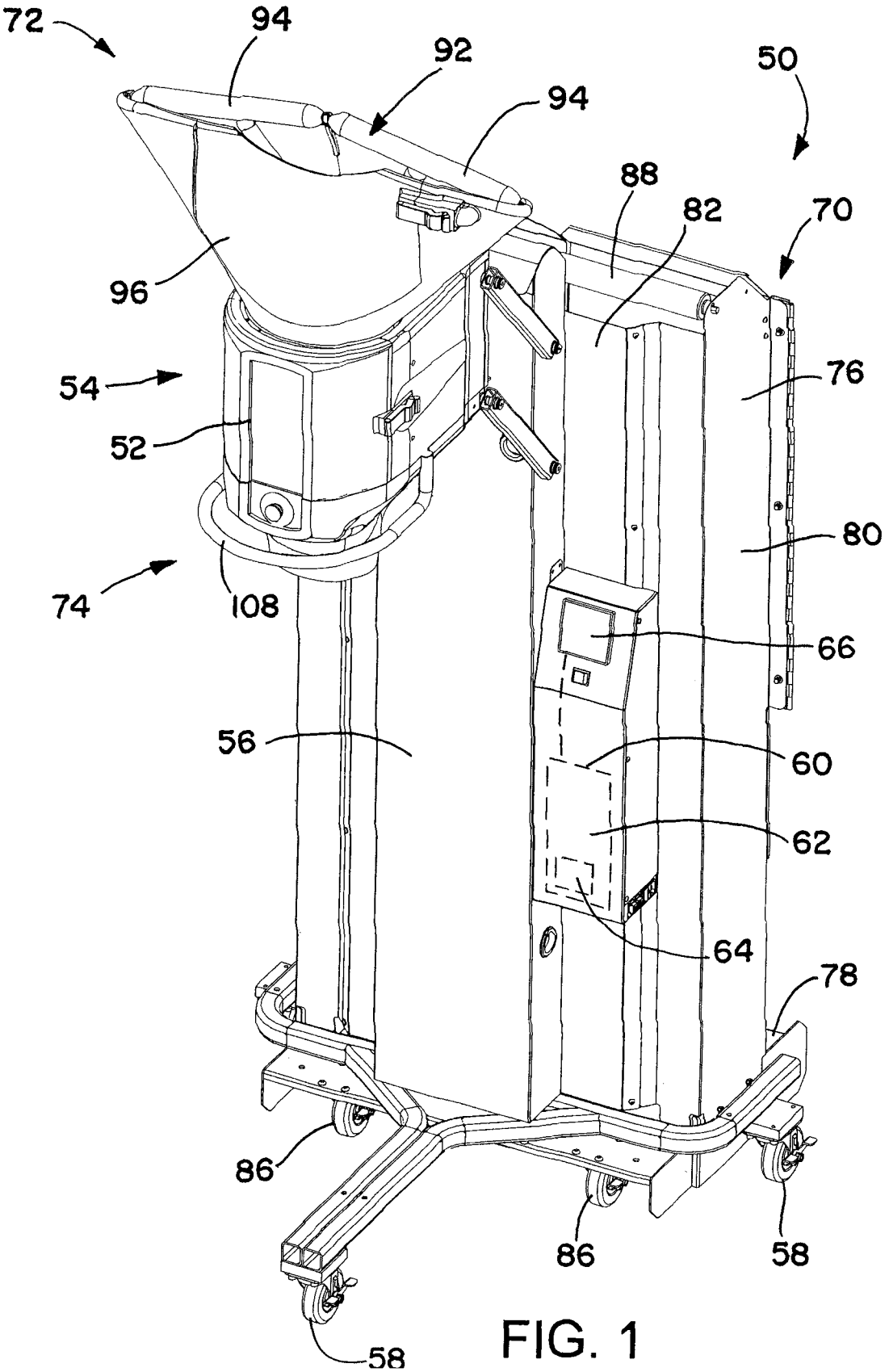
FIG. 1 is a perspective view of an exemplary dunnage conversion machine and stock supply provided by the present invention.
Figure 2:
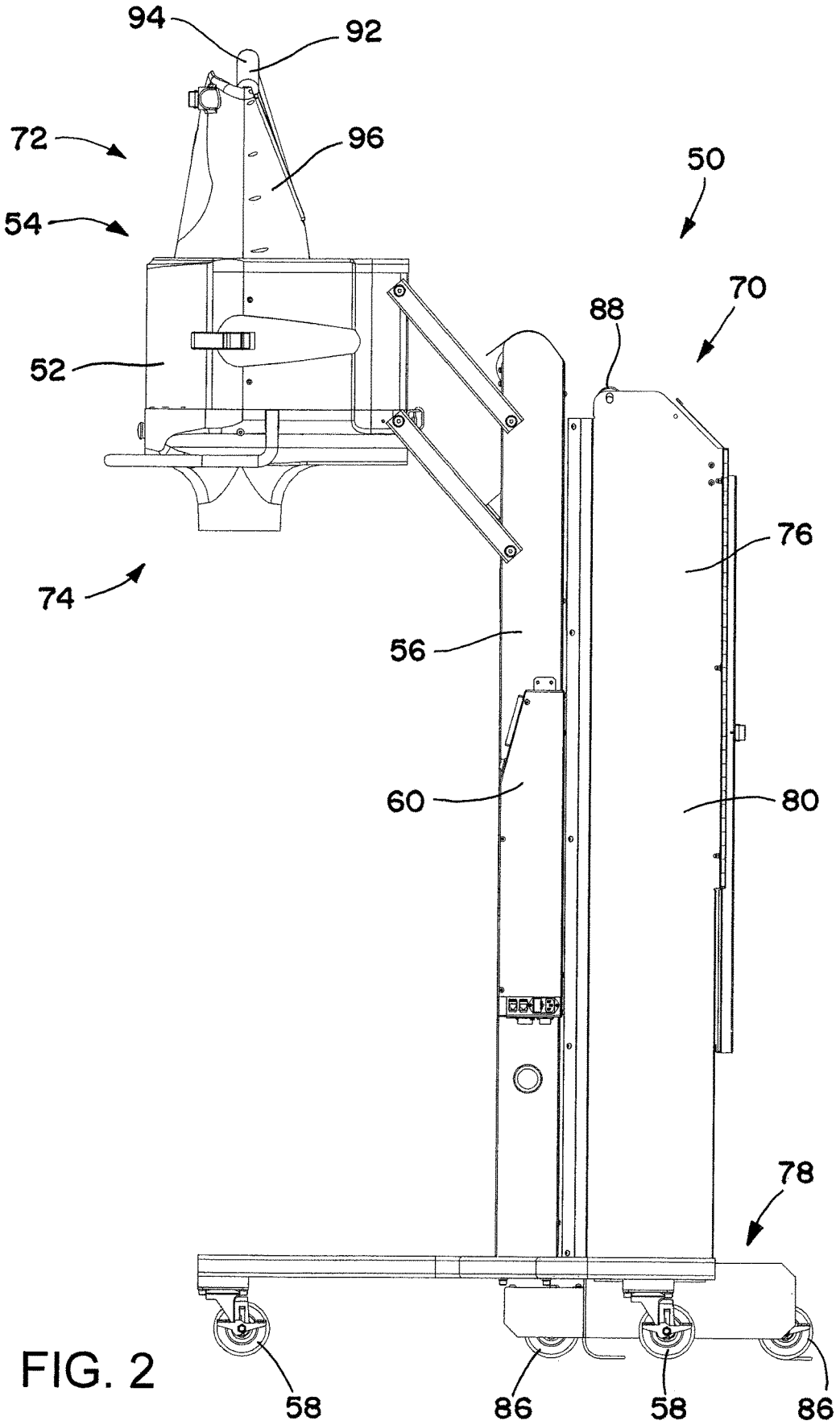
FIG. 2 is a side view of the dunnage conversion machine of FIG. 1.
Figure 3:
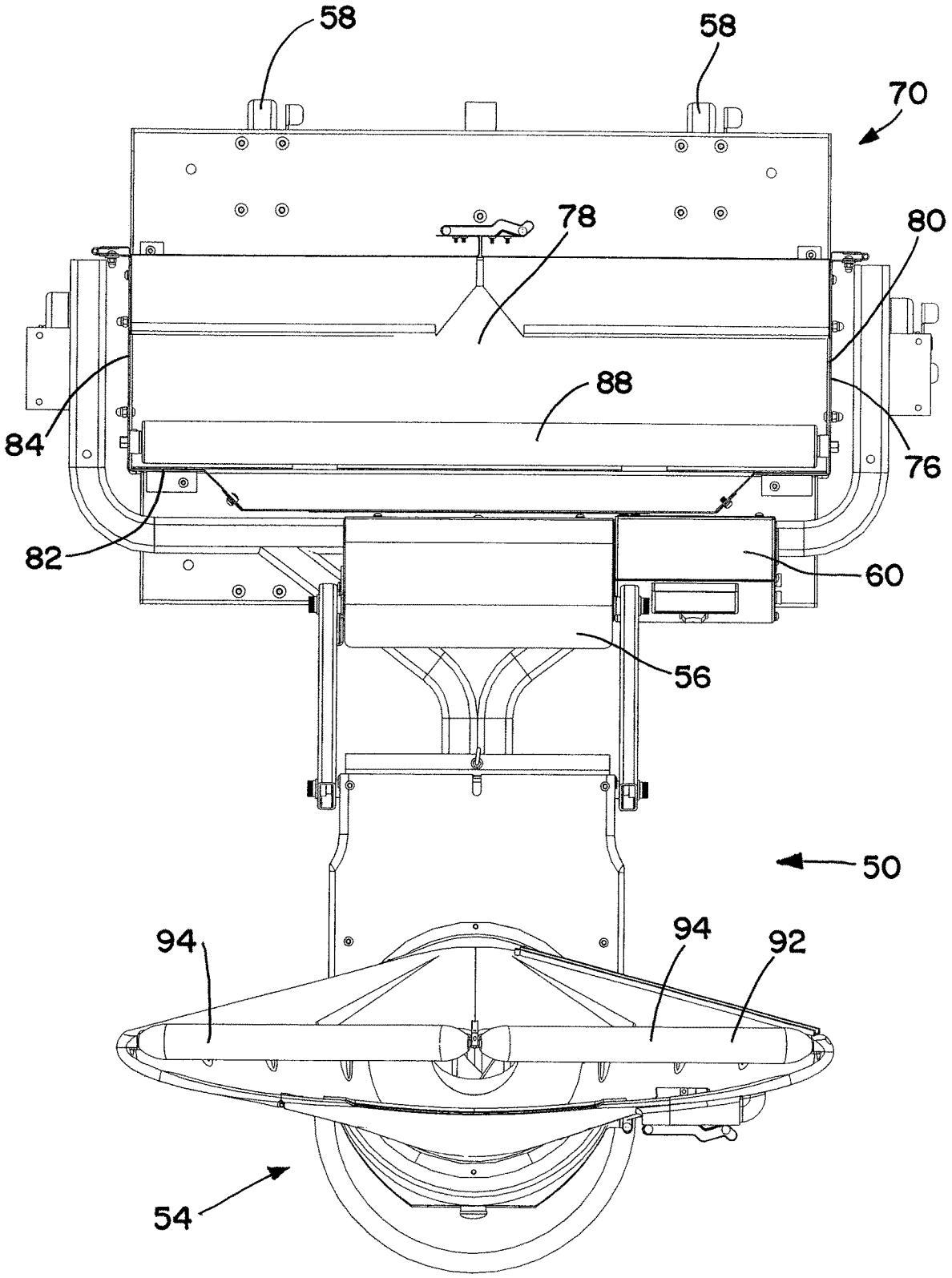
FIG. 3 is a top view of the dunnage conversion machine of FIG. 1.

An exemplary machine for converting a sheet stock material into a dunnage product is shown in FIGS. 1-3. The machine 50 has a housing 52 and a conversion assembly 54 (further details described below) substantially within the housing 52 for converting sheet stock material into a dunnage product. The conversion assembly 54 is mounted to a stand 56 or other upright support frame at an elevated position. The illustrated stand 56 is mounted on wheels 58 to facilitate moving the conversion machine 50. The stand 56 also supports a controller 60 in communication with the conversion assembly 54. The controller 60 includes a processor 62, a memory 64, an input device for entering information and an output device for displaying information about the status of the conversion assembly 54. The illustrated controller 60 uses a touch screen display 66 as a combined input device and output device. The controller 60 controls the conversion assembly 54 to convert a sheet stock material provided by a supply 70 into a crumpled, relatively less dense dunnage product.

The illustrated supply 70 includes a stand 76 with a base 78 and upright side walls 80, 82, and 84 perpendicular to adjacent side walls and to the base to define a compartment for supporting a stack of fan-folded sheet stock material. The illustrated stand 76 is provided with wheels 86 to make it easier to move. Since it has wheels, the stand 76 also can be called a cart. The stock supply cart 76 is maneuverable separate from the stand 56 that supports the conversion assembly 54 so that the supply of stock material can be replenished without moving the conversion assembly 54 and so that the supply 70 can be located at different positions relative to the stand 56 for the conversion assembly 54. The stock supply cart 76 also includes a transversely extending guide or guide member 88 at an upper end to facilitate drawing the stock material from the cart 76. The illustrated transverse guide member 88 includes a roller.

The conversion machine 50 also includes a transversely extending guide 92 over which the stock material passes for guided entry into the upstream end 72 of the conversion assembly 54. The guide 92 can be considered to be a part of the conversion assembly 54 due to its function, explained below, but for purposes of this description it will be described as a separate component. The illustrated guide 92 includes a pair of rollers 94, each of which has rounded ends, arranged in an end-to-end relationship with their respective axes of rotation at an angle to one another. This angled relationship and the rounded ends help to induce lateral portions of the sheet stock material to turn inwardly as it enters the conversion assembly 54, and to maintain a relatively uniform tension on the sheet stock material.

The guide 92 is spaced from an upstream end 72 of the conversion assembly 54 by a frame, which in this embodiment is integrated into an upper housing 96. Alternatively, the upper housing can be mounted to a separate frame that supports the guide 92. The upper housing 96 extends between the guide 92 and the conversion assembly 54, and is separate from the lower housing 52 that encloses the conversion assembly 54. The guide 92 and the upper housing 96 are rotatable together as a unit about a generally vertical axis relative to the conversion assembly 54 and the lower housing 52 such that the transverse extent 154 (see FIGS. 16 and 17) of the guide 92 can be moved between a plurality of relatively rotated orientations. This feature makes it possible to guide sheet stock material into the conversion assembly 54 from different directions.

The conversion assembly 54 includes a longitudinal axis 104 (FIG. 6), and the conversion assembly 54 converts sheet stock material into a dunnage product as the stock material travels substantially along the longitudinal axis 104 from the upstream end 72 to a downstream end 74 of the conversion assembly 54. In the illustrated embodiment, the longitudinal axis 104 of the conversion assembly 54 is vertical, but other orientations are contemplated.

The conversion assembly 54 includes a feed assembly having a movable device, such as one or more rotatable members for drawing stock material through the conversion machine along the longitudinal axis 104. Exemplary rotatable members include gears, paddle wheels, finned or studded shafts, driven belts, etc. The conversion assembly 54 also includes a forming assembly upstream of the feed assembly through which the stock material is pulled. The forming assembly can include a converging chute, for example, to inwardly gather and crumple the stock material passing through the forming assembly. The present invention is not limited to the illustrated conversion assembly 54. Alternatively, the forming assembly can include an inflation and sealing device for forming air bags.

Figure 4B:
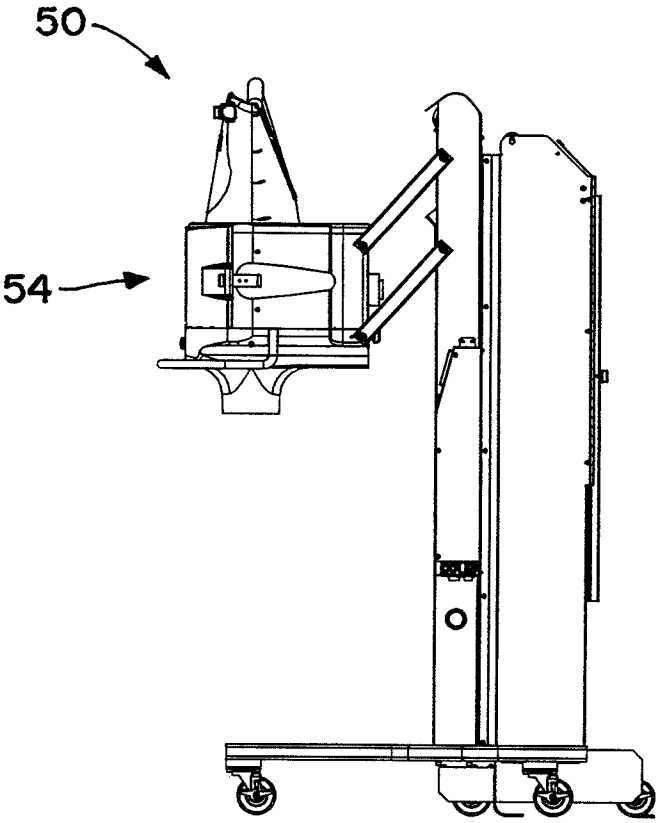
FIGS. 4A and 4B are side views of the dunnage conversion machine of FIG. 1 with a conversion assembly portion in an elevated position and a lowered position, respectively.
Figure 4A:
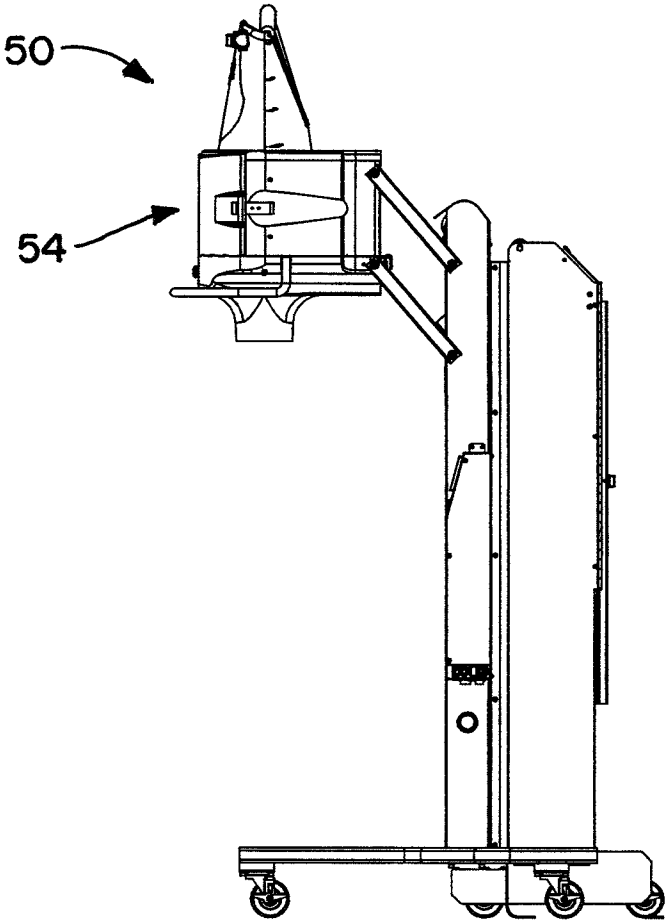

The conversion assembly 54 is mounted to the stand 56 by a linkage or linkage mechanism 106. The linkage 106 provides the means for translating movement of the conversion assembly 54 relative to the stand 56 or other support without changing the orientation of the conversion assembly 54. The linkage 106 also supports and guides the conversion assembly 54 while simultaneously horizontally and vertically translating the conversion assembly 54 without rotating the conversion assembly about a generally horizontal axis. As shown in FIGS. 4A and 4B, for example, the linkage 104 allows the conversion assembly to be moved between an elevated position (FIG. 4A) and a lowered position (FIG. 4B) while maintaining its longitudinal axis 104 (FIG. 6) in a substantially vertical orientation. The illustrated conversion assembly 54 includes a handle 108 to help the packer to move conversion machine 50 or the conversion assembly 54. The elevated position typically is used during operation of the conversion assembly 54 (an operating position), and the lowered position typically is used for feeding a new supply of stock material into the conversion assembly 54, for routine maintenance, or for clearing jams (a non-operating position). Alternatively, the purposes of these relative positions can be reversed, whereby a lowered position may be the operating position and the elevated position may be a non-operating position. Advantageously, the conversion assembly 54 can be operated in any position including in between the elevated and lowered positions, which is particularly useful for packers who prefer the conversion assembly 54 at a relatively higher or lower position.

Figure 5:
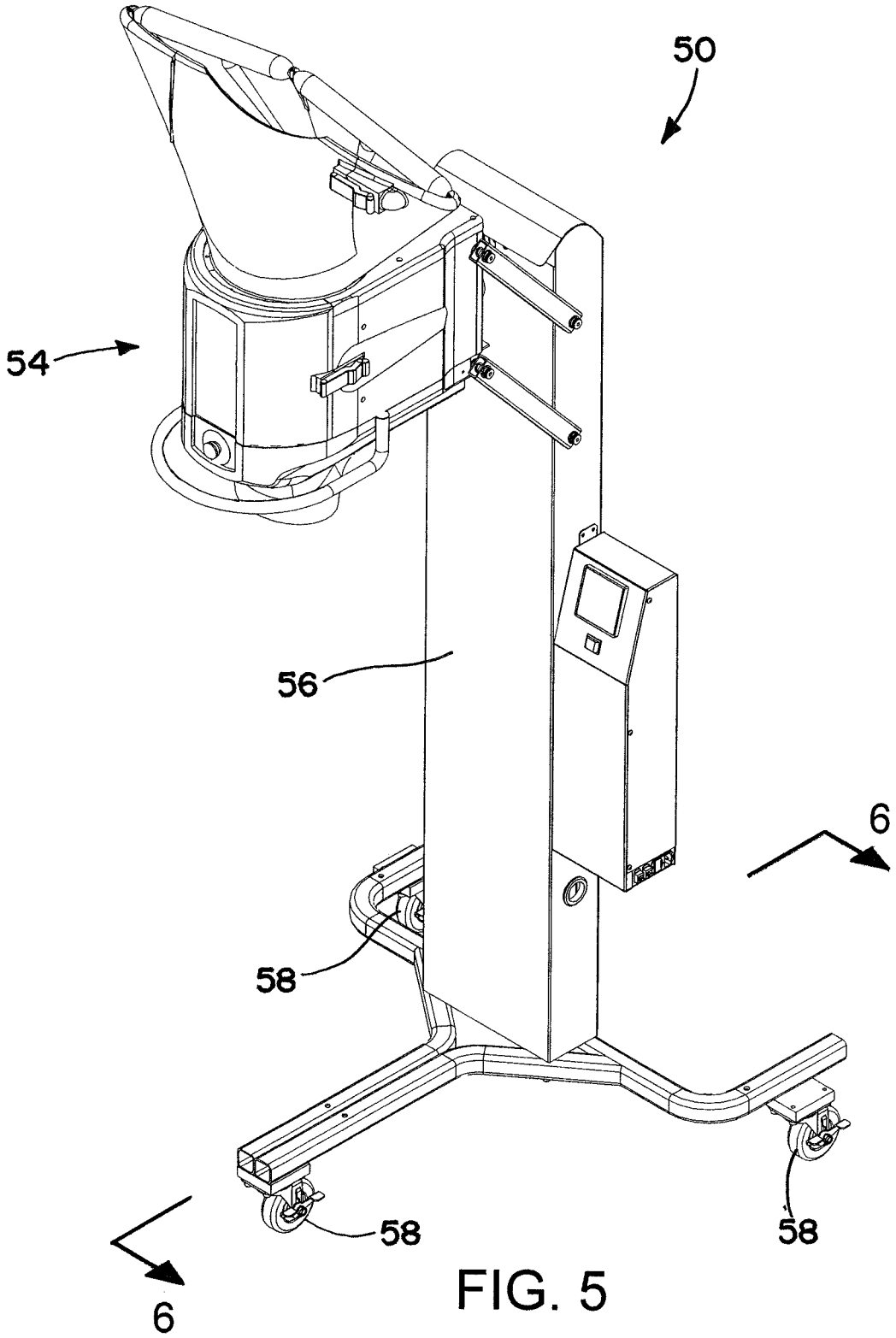
FIG. 5 is a perspective view of the dunnage conversion machine of FIG. 1.
Figure 6:
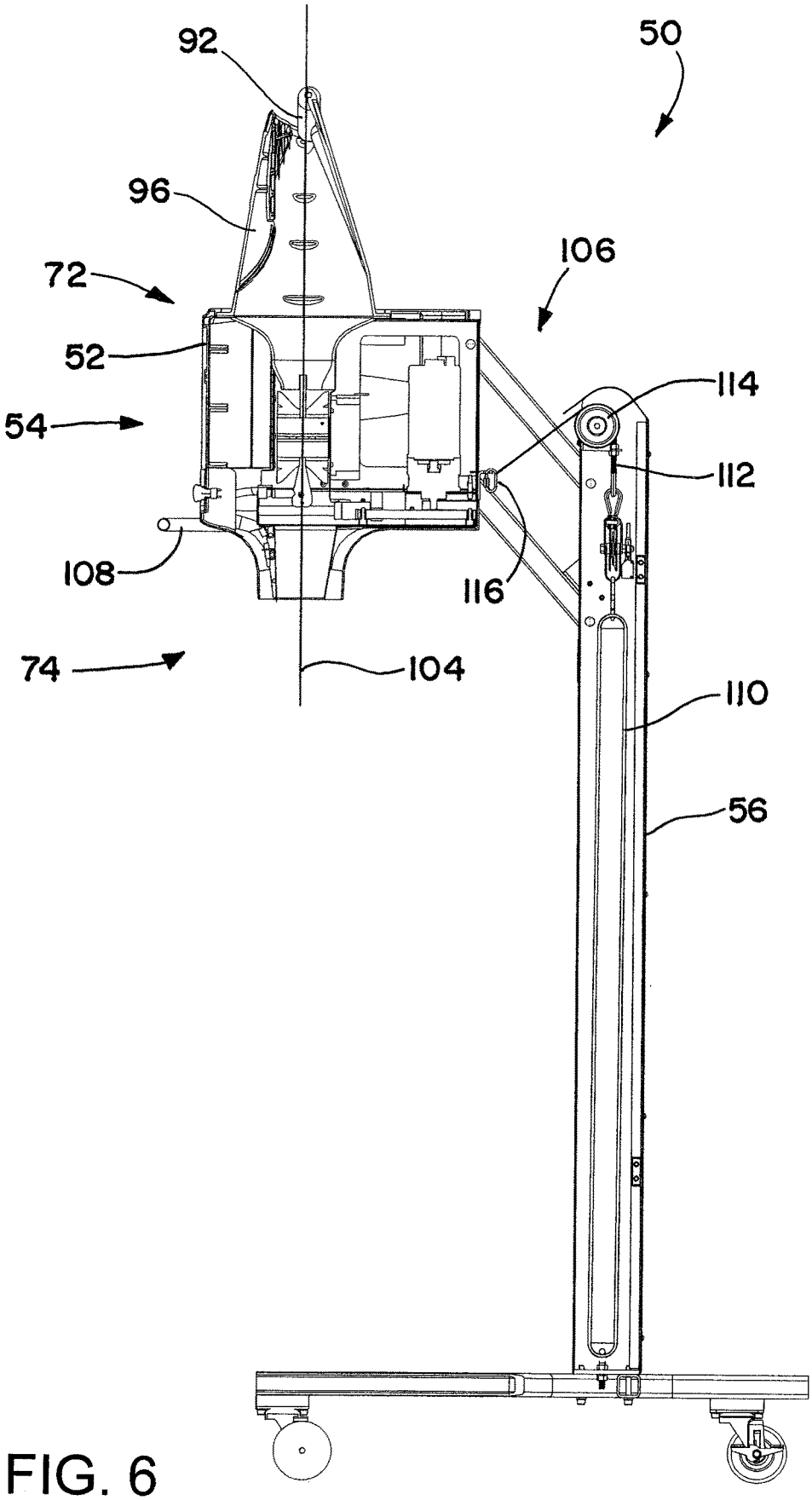
FIG. 6 is a cross-sectional side view of the dunnage conversion machine as seen along line 6-6 of FIG. 5.
Figure 7:
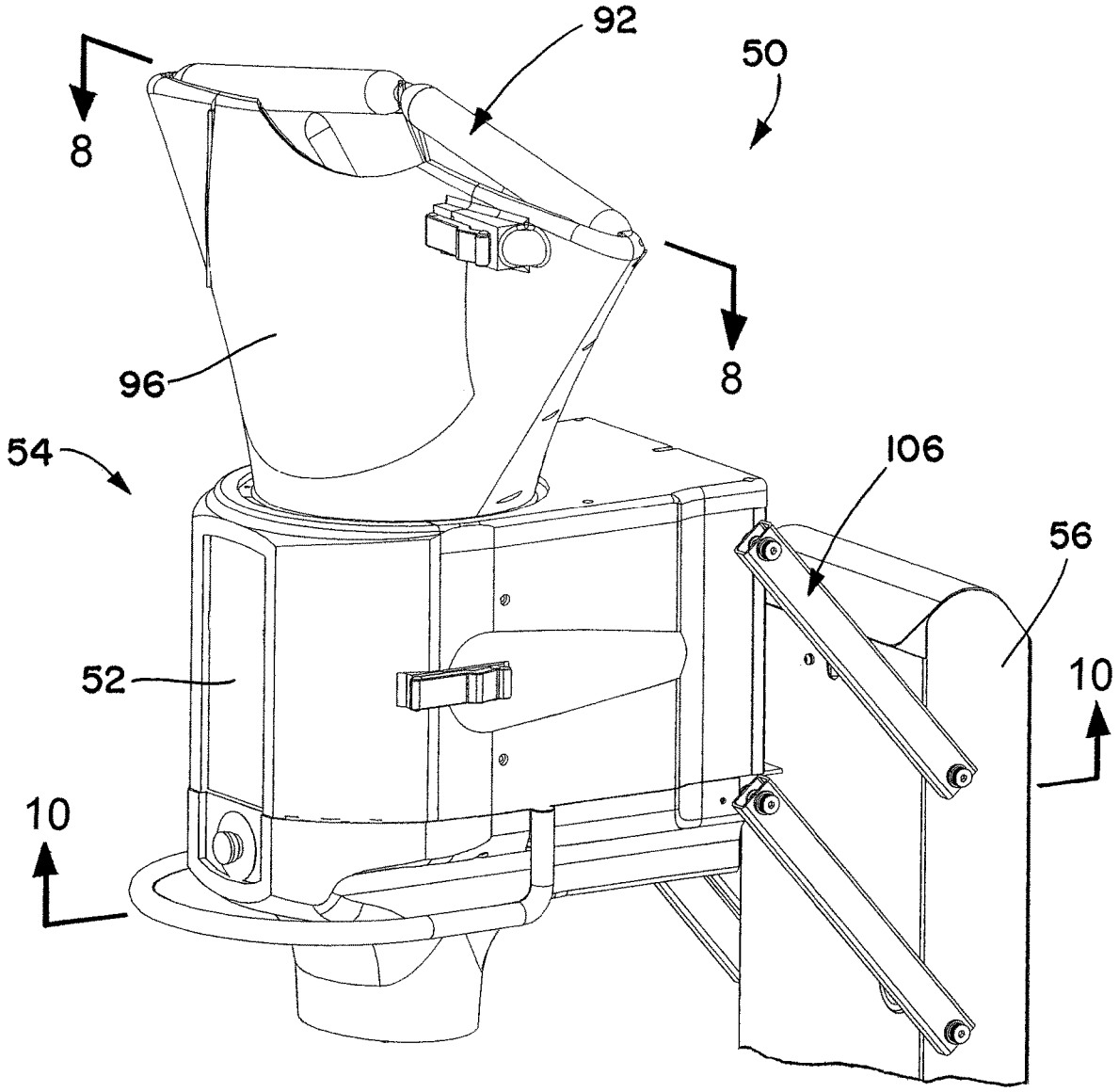
FIG. 7 is an enlarged perspective view of a conversion assembly portion of the dunnage conversion machine of FIG. 5.
Figure 8:
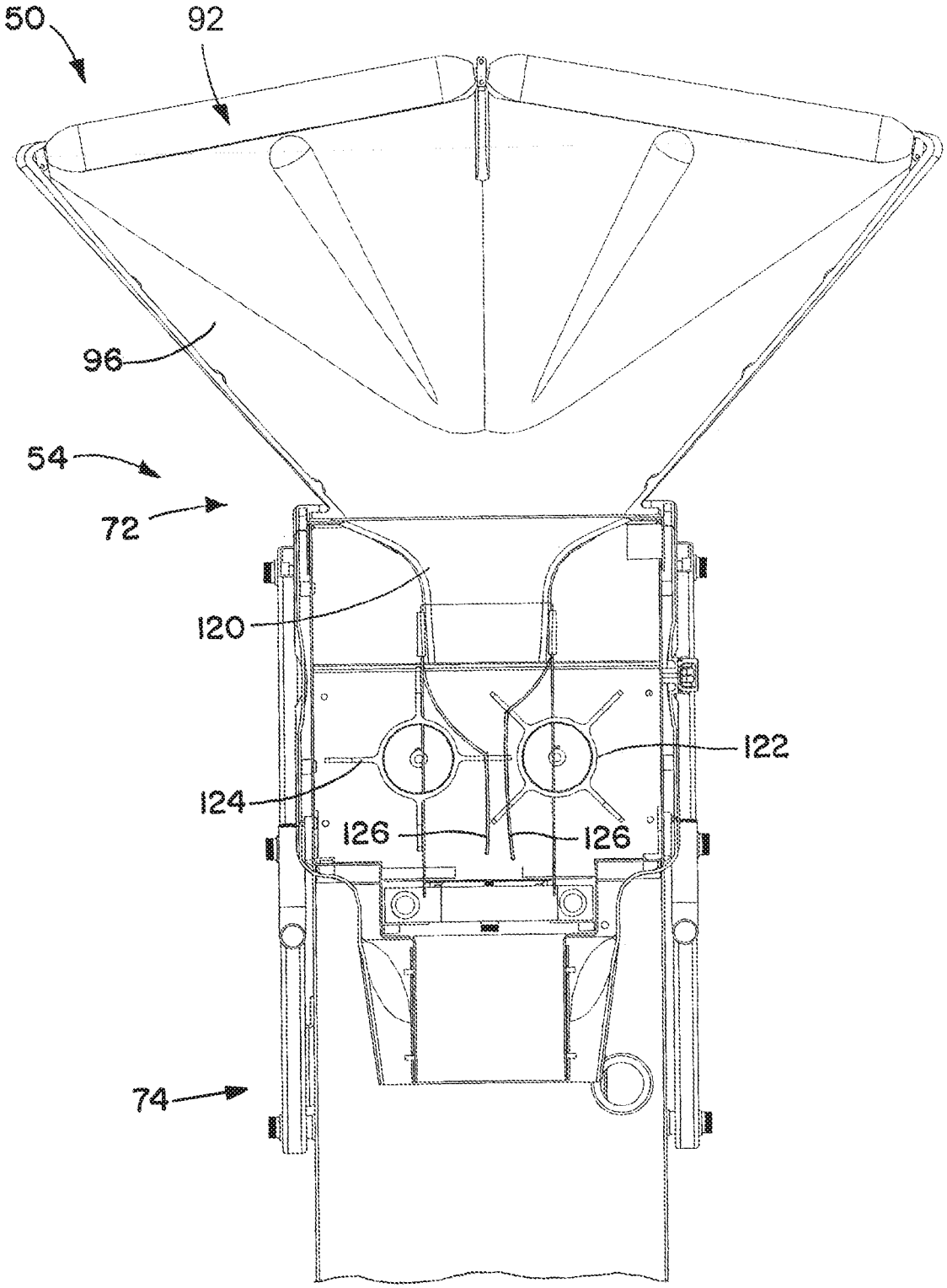
FIG. 8 is a cross-sectional view of the conversion assembly as seen along line 8-8 of FIG. 7.
Figure 9:
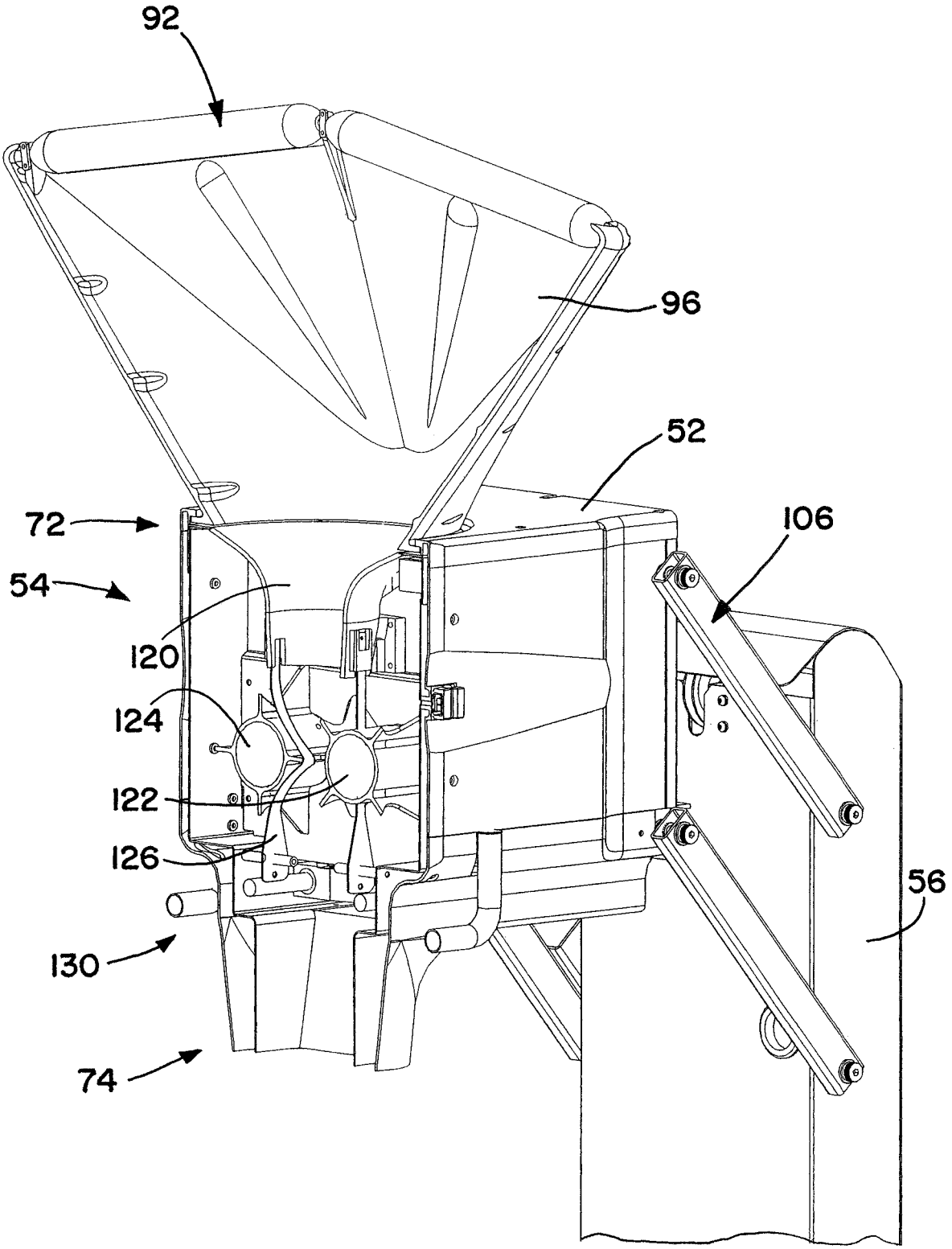
FIG. 9 is a perspective view of FIG. 8.
Figure 10:
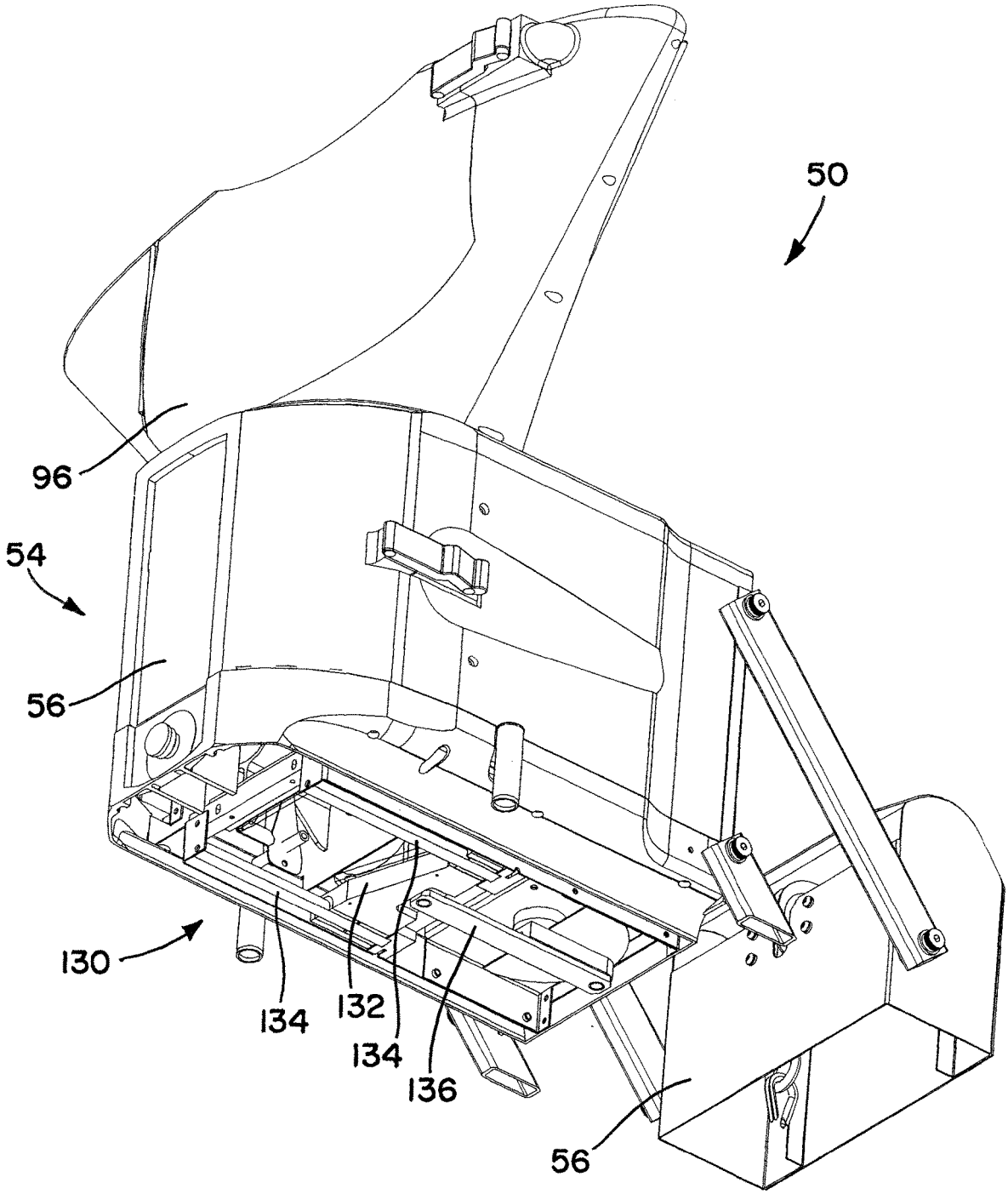
FIG. 10 is a cross-sectional view of the conversion assembly as seen along line 10-10 of FIG. 7.

In FIG. 5 the conversion machine 50 is shown without the stock supply cart. A vertical section of this machine 50 is shown in FIG. 6. To hold the conversion assembly 54 at a desired elevation, the weight of the conversion assembly 54 is counterbalanced by a weight or other force-balancing mechanism. In this embodiment, we used a pair of springs 110, such as those used to counterbalance a garage door, housed in an upright portion of the stand 56. One end of each spring is connected toward a bottom of the stand 56, and the other end is connected to a cable 112 that passes over a pulley 114 and connects to a fitting 116 on the conversion assembly 54, its frame or the lower housing 52.

The section shown in FIG. 6 also illustrates the internal features of the conversion assembly 54. Referring now to FIGS. 6-10, the upper housing 96 substantially encloses the forming assembly. The upper housing 96 defines a substantially continuous surface that transitions from a relatively narrow slit at an upstream end adjacent the guide 92 to the upstream end 72 of the conversion assembly 54 at its downstream end. The upper housing covers or defines a converging chute 120 that inwardly gathers the sheet stock material as the stock material moves toward the feed assembly. The chute 120 converges from a relatively larger upstream end to a relatively smaller downstream end along the longitudinal axis 104. The chute 120 is rotationally symmetric about the longitudinal axis 104 so that the stock material can enter the chute 104 from any direction.

As mentioned above, the conversion assembly 54 also includes the feed assembly downstream of the forming assembly. The feed assembly includes a movable device that moves stock material through the conversion assembly. In the illustrated embodiment, the movable device includes a pair of opposing paddle wheels 122 and 124 downstream of the converging chute 120 to pull the sheet stock material through the chute 120, inwardly gathering lateral portions of the sheet and crumpling the sheet stock material in the process. The paddle wheels 122 and 124 further inwardly gather and crumple the sheet, and also tend to crease the folds in the stock material so that it will better retain its crumpled state as it passes out the downstream end 74 of the conversion assembly 54. A pair of guide strips 126 are secured upstream of the paddle wheels 122 and 124 and extend between and beyond the paddle wheels 122 and 124 to help guide the stock material through the paddle wheels and to minimize or eliminate jamming as the crumpled strip passes.

Downstream of the paddle wheels 122 and 124 or other movable device in the feed assembly, the conversion assembly 54 also includes a severing assembly 130 for separating a desired length of dunnage from the crumpled strip. The illustrated severing assembly 130 includes a cutting blade 132 mounted on a pair of guide rods 134. The cutting blade 132 is driven by a motor (not shown) and a crank arm 136 for reciprocal motion across the path of the crumpled strip. The invention is not limited to the illustrated chute, paddle wheels, and severing assembly, and other components can be used in place of one or more of the illustrated components. The illustrated embodiment is but one way to convert a sheet stock material into a strip of dunnage.

Figure 11:
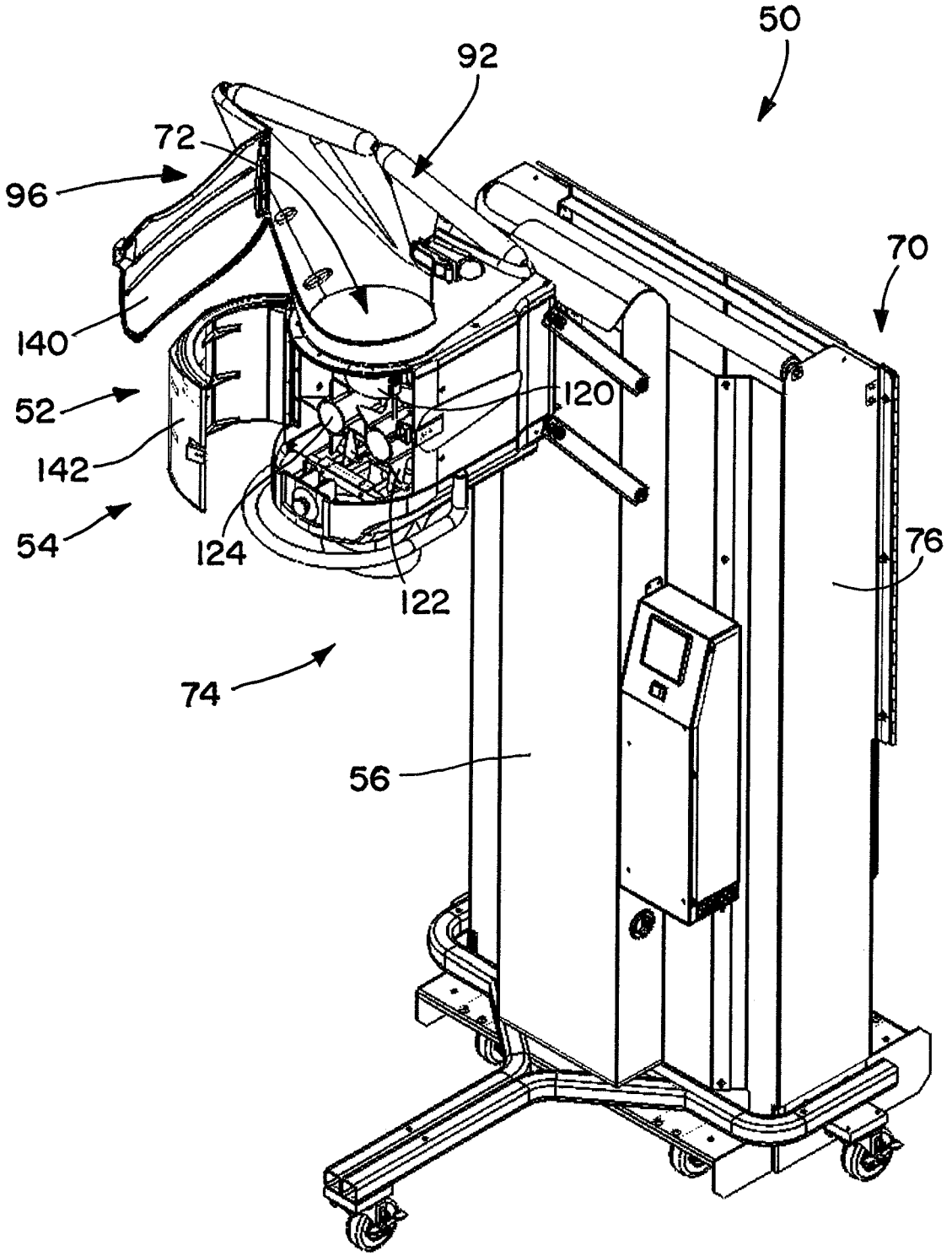
FIG. 11 is a perspective view of the dunnage conversion machine of FIG. 1 with access doors on the conversion assembly opened to reveal internal components.

As mentioned above, the upper housing 96 encloses the space from the guide 92 to the upstream end 72 of the conversion assembly 54. This helps to contain and minimize any noise and dust generated by the conversion process. The lower housing 52 encloses the components of the conversion assembly 54. As shown in FIG. 11, the housing includes at least one door that is openable to access the upstream end 72 of the conversion assembly 54. The illustrated upper housing 96 encloses a space from the guide 92 to the upstream end of the conversion assembly 54. The upper housing 96 has an upper door 140 adjacent the guide 92 that provides access to an upstream end 72 of the conversion assembly 54 generally and particularly the converging chute 120, and the lower housing 52 has a lower door that opens to provide access to the downstream end of the chute 120 and the paddle wheels 122 and 124, which is where a jam is most likely to occur. Opening one or both of the doors 140 and 142 also can make it easier to feed in a new sheet of stock material or provide maintenance on the conversion assembly 54. The illustrated doors are hingedly mounted, but also could be secured and opened and/or removed in another manner.

The upper housing 96 and the lower housing 52, and their respective components, are rotatable relative to one another about the longitudinal axis 104, which in the illustrated embodiment is substantially vertical. Rotating the upper housing 96 also rotates the transversely extending guides that guide the stock material into the conversion assembly, making it possible to feed stock material into the conversion assembly from any relatively rotated direction.

Figure 12:
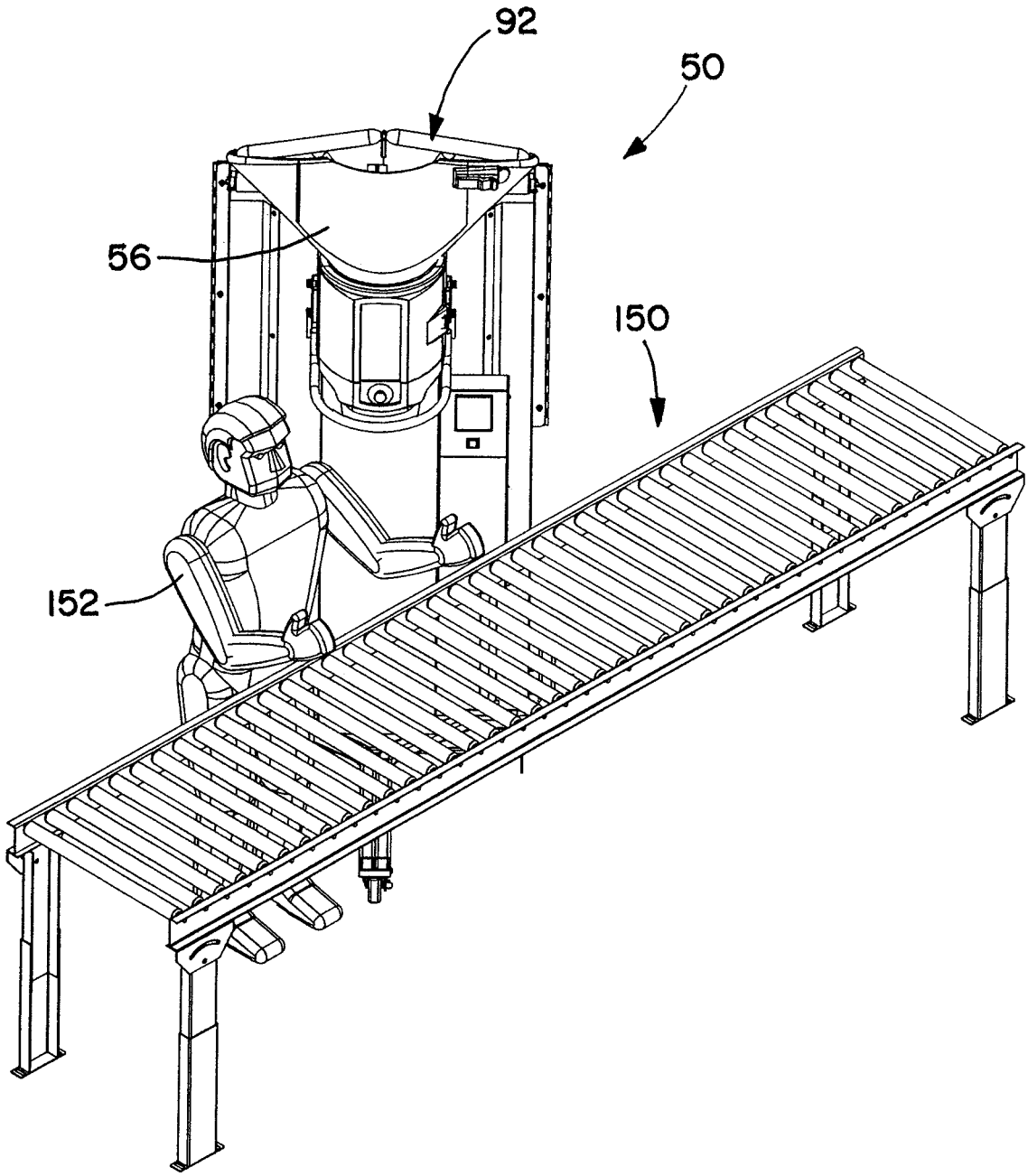
FIG. 12 is a perspective view of a packing station with the conversion machine of FIG. 1.
Figure 13:
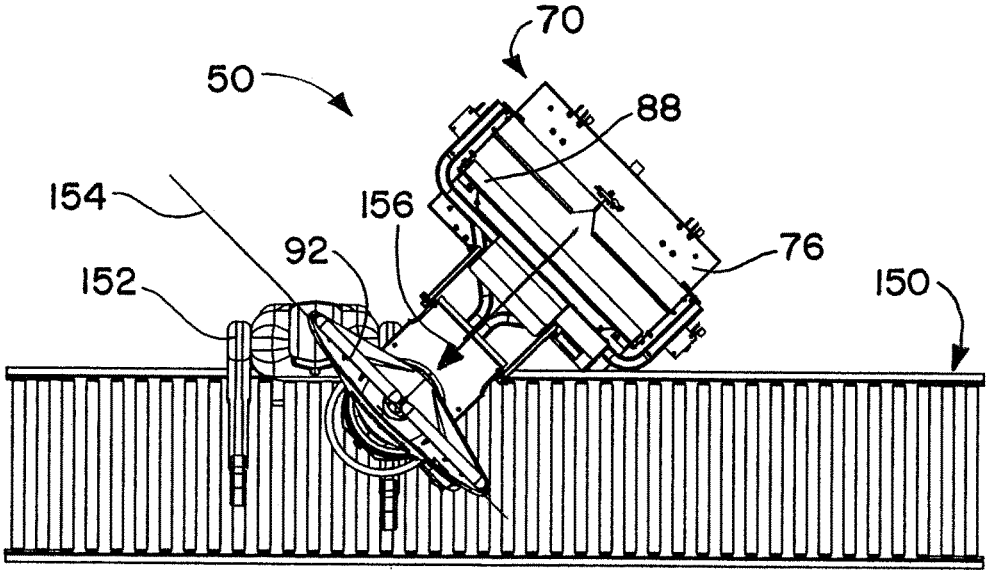
FIG. 13 is a top view of the packing station of FIG. 12.
Figure 14:
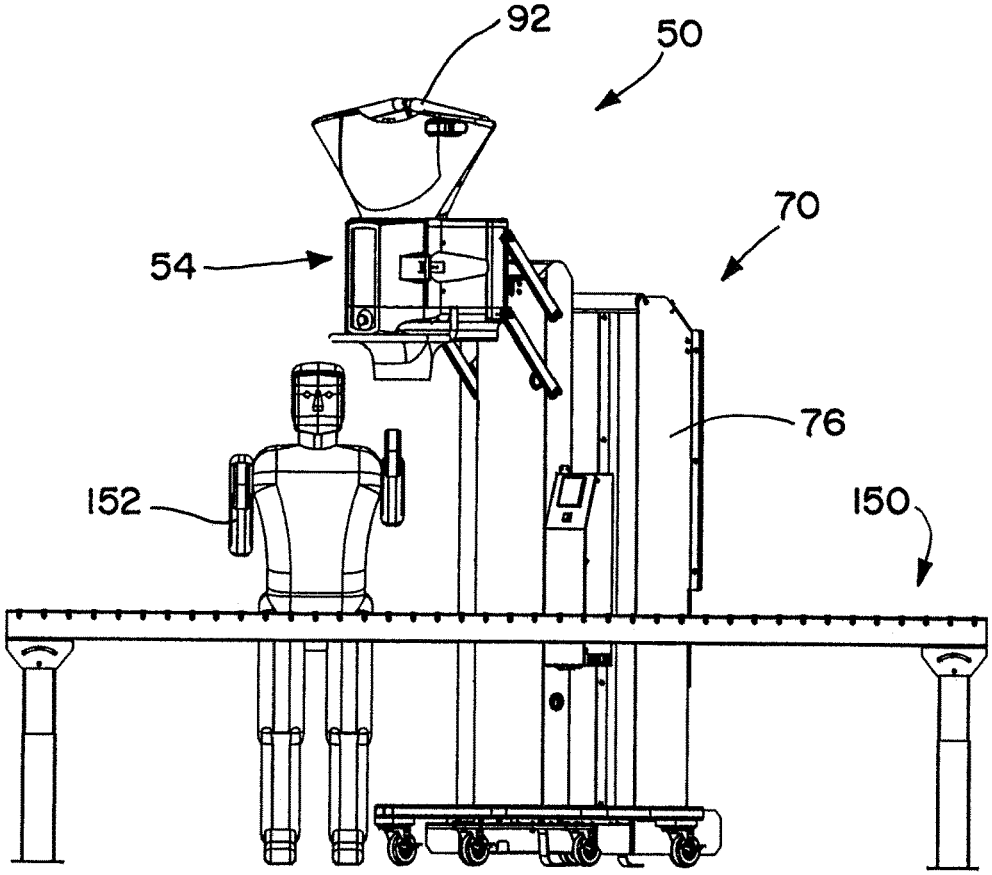
FIG. 14 is a front view of the packing station of FIG. 12.
Figure 15:
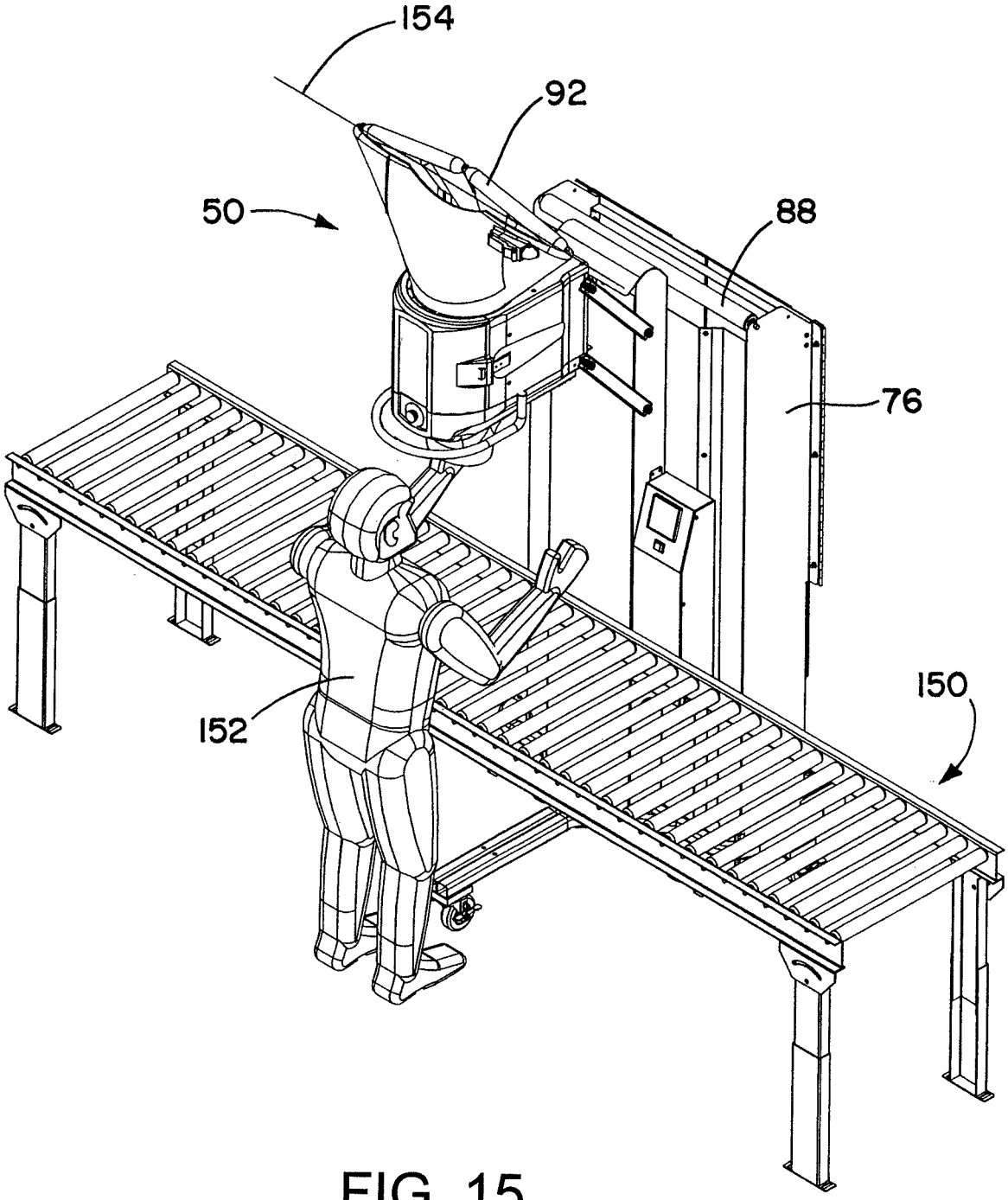
FIG. 15 is a perspective view of another packing station with the conversion machine of FIG. 1.

FIGS. 12-17 show the conversion machine 50 and its stock supply cart 76 in various configurations that illustrate the versatility provided by the rotating guide-and-housing unit. In FIGS. 12-14 both the conversion machine 50 and stock cart 76 are provided on the same side of a conveyor 150 or other packing surface as a packer 152 for dispensing dunnage to one side of the packer or over the packer's shoulder. The lateral extent 154 of the guide 92 (defined as a line extending between the ends of the guide 92 as shown) is perpendicular to the direction 156 from which the stock material is fed to it and then into the conversion assembly 54. The stock supply guide 88 also is parallel to the lateral extent 154 of the guide 92. Alternatively, as shown in FIG. 15, the conversion machine 50 and stock cart 76 both can be stationed on an opposite side of the conveyor 150 from the packer 152.

Figure 16:
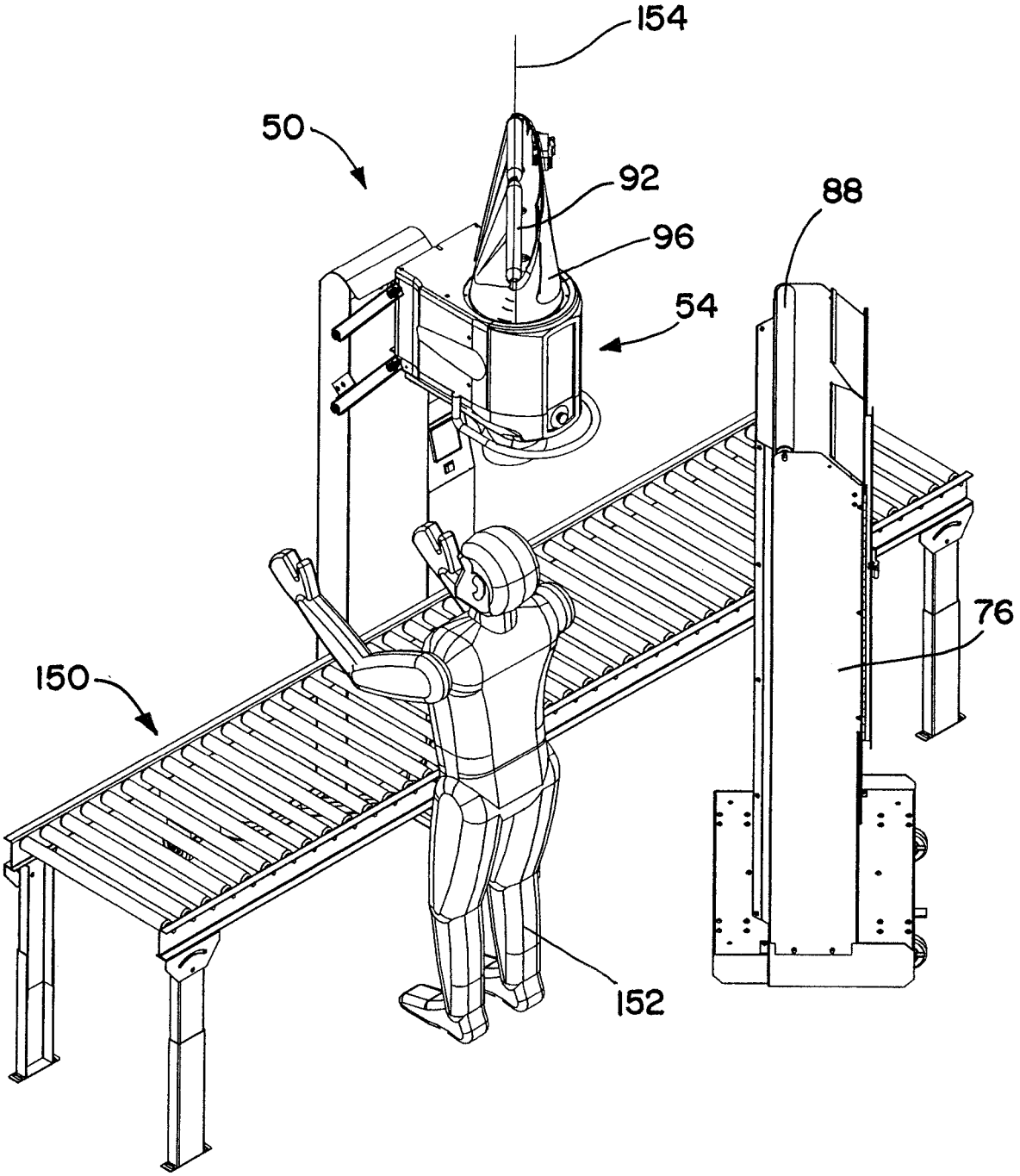
FIG. 16 is a perspective view of another packing station with the conversion machine of FIG. 1.
Figure 17:
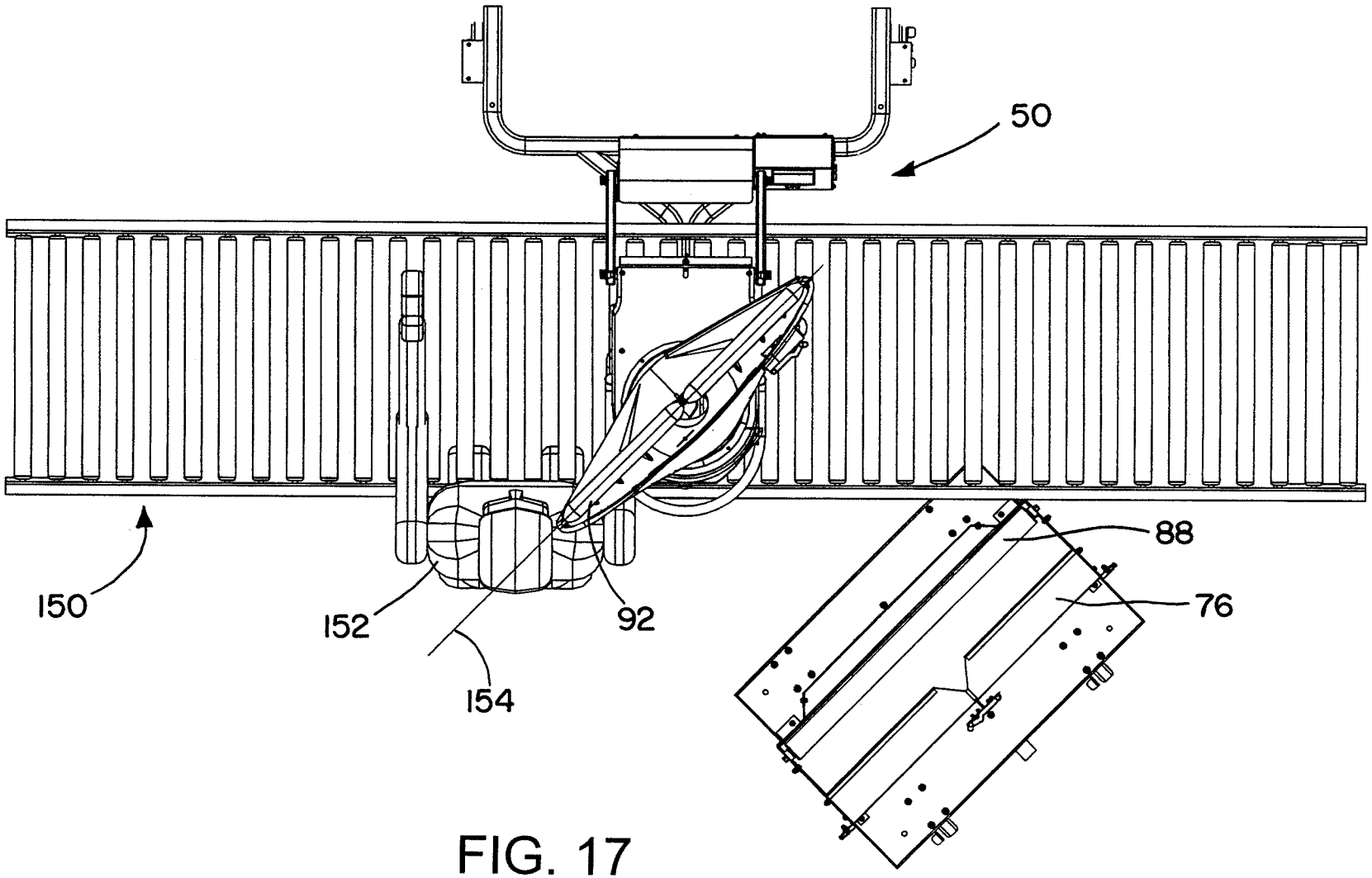
FIG. 17 is a top view of the packing station of FIG. 16.

Another alternative arrangement is shown in FIGS. 16 and 17, where the conversion machine 50 is stationed on one side of the conveyor 150 and both the packer 152 and the stock cart 76 are stationed on the opposite side of the conveyor. This allows the packer to work facing the conversion machine, while also having the stock supply cart on the same side with the packer, readily accessible and replaceable by the packer without crossing over or under the conveyor 150. This illustrates an advantage provided by the rotatable guide 92. In this arrangement, the guide 92 and the upper housing 96 rotate relative to the lower housing 52 to position the lateral extent 154 of the guide 92 parallel to the stock cart's transverse guide member 88, perpendicular to the feed direction. Since the chute 120 (FIG. 9) is symmetric about the vertical longitudinal axis 104 (FIG. 6) of the conversion assembly 54, the conversion process is substantially consistent regardless of the orientation of the guide 92 and the stock cart 76 relative to the conversion assembly 54.

The conversion machine 50 shown and described can be used with other types of stock material supplies and is not limited to the supply 70, just as the supply 70 is not limited to the conversion machine 50 shown and described. FIGS. 18-26 show alternative stock supplies for a dunnage conversion machine 50. Each of these stock supplies can support multiple stacks of sheet stock material in a way that facilitates feeding the stock material from the supply to the conversion machine. Although one or more plies of paper provides an exemplary sheet stock material for conversion into a crumpled dunnage product, the invention is not limited to the use of paper or the conversion of paper into a crumpled dunnage product. Another exemplary sheet stock material, for example, is a plastic sheet, including one or more plastic sheets for conversion into air bags. Moreover, none of these stock supplies is limited to use with an illustrated dunnage conversion machine.

Figure 18:
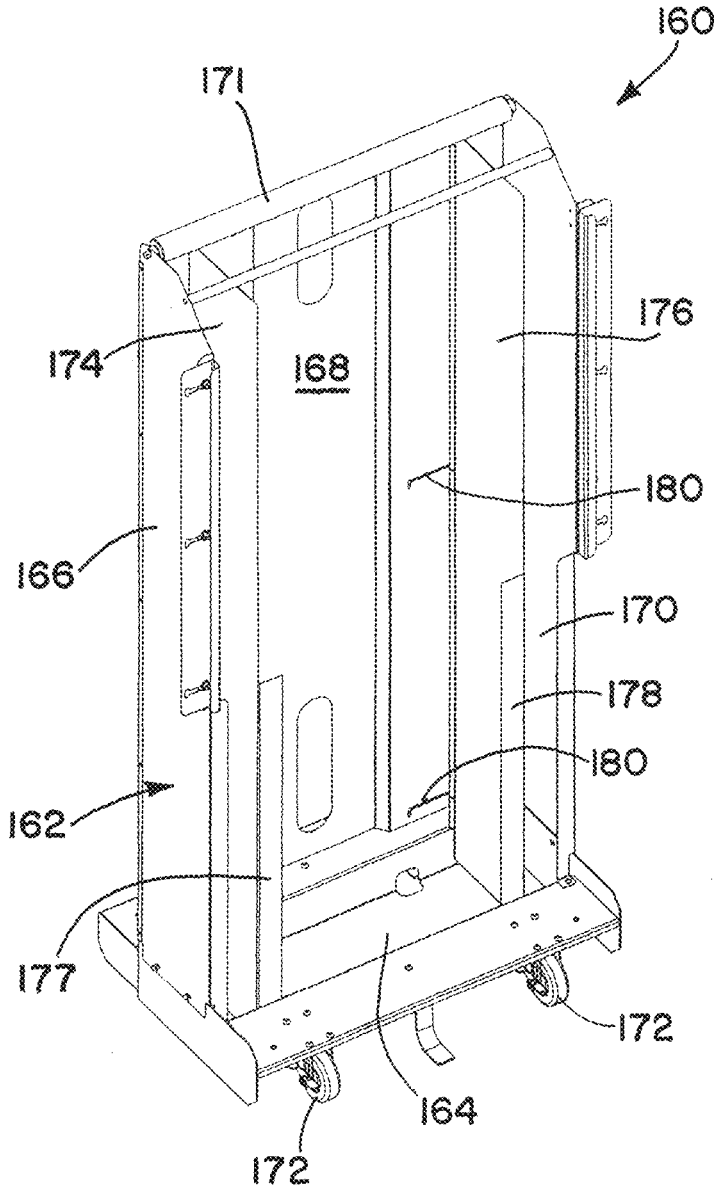
FIG. 18 is a perspective view of another stock supply provided in accordance with the invention.
Figure 19:
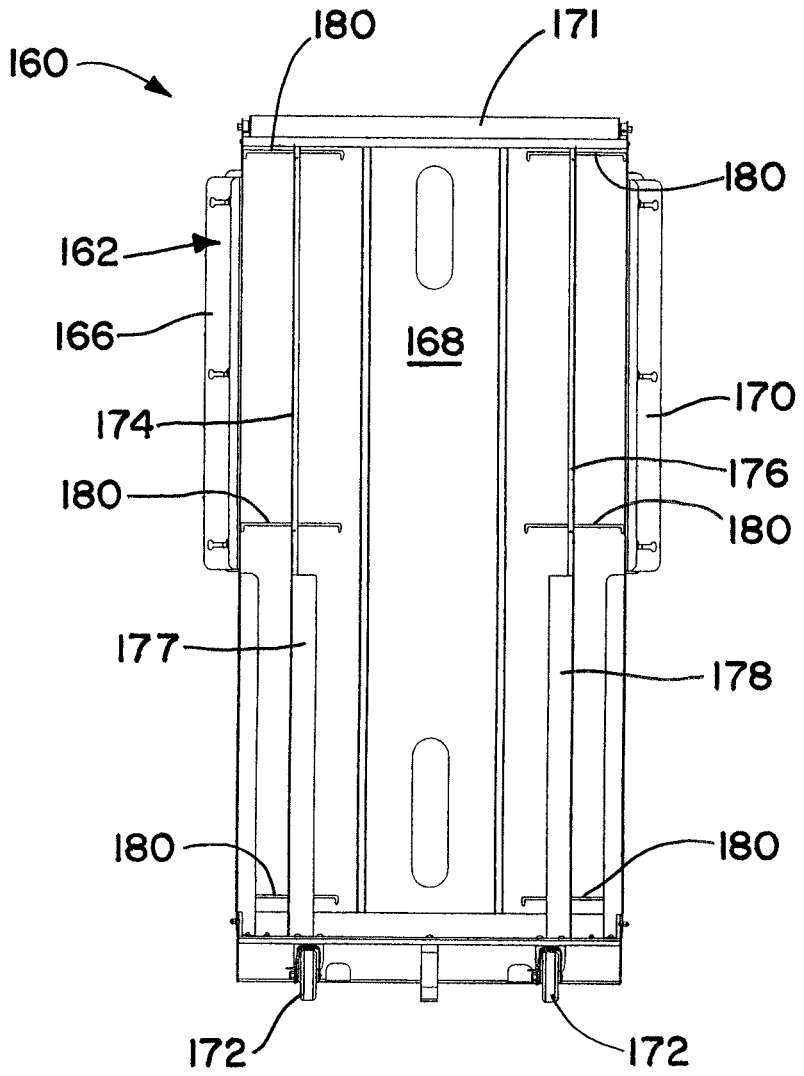
FIG. 19 is a front elevation view of the stock supply of FIG. 18.

The stock supply 160 shown in FIGS. 18 and 19 includes an adjustable device or means for supporting a stack of sheet stock material for conversion into a dunnage product, regardless of its width. The stock supply 160 includes a stand 162 with a base 164 and upright side walls 166, 168 and 170 arranged perpendicular to adjacent side walls and to the base. Alternatively, the stand 162 for the stock material can be incorporated into a stand for a dunnage conversion machine. The side walls 166, 168, and 170 and the base 164 define a compartment for supporting a stack of fan-folded sheet stock material.

The stand 162 also includes a transverse guide member 171 extending between upper ends of the side walls 166 and 170 that guides the sheet stock material pulled from the stock supply 160. The transverse guide member 171 typically includes a roller. The illustrated stand 162 is provided with wheels 172, so it also can be referred to as a cart.

The cart 162 includes a pair of laterally-spaced upright supports 174 and 176, with at least one of the lateral supports 174 and 176 being laterally adjustable relative to the other lateral support to accommodate different widths of stock material. As is the case with the side walls in each of the other stock supplies shown in the drawings, each of the lateral supports 174 and 176 includes an inwardly-extending front wall 177 and 178 that helps to support a front side of a stack of sheet stock material. These front walls 177 and 178 only extend part of the height of the supports 174 and 176 so that the stacks of sheet stock material can be lifted over and placed behind the front walls 177 and 178.

In the illustrated embodiment, both lateral supports 174 and 176 are movable in a horizontal direction toward and away from one another. The lateral supports 174 and 176 do not extend as high as the side walls 166 and 170 so that they can move underneath the transverse guide roller 171. The back wall 168 includes parallel slots 180 within which extensions of the lateral supports 174 and 176 extend. Tabs, bolts, or other extensions of the lateral supports 174 and 176 extend through the slots 180 to support the lateral supports 174 and 176 and yet allow the supports to move relative to the back wall 168 while remaining parallel to each other and perpendicular to the back wall 168.

Instead of or in addition to the adjustable lateral supports 174 and 176 or other features of the stock supplies 70 and 160 shown and described in FIGS. 1 and 18, respectively, the stock supplies shown in FIGS. 20-24 can provide ways to compactly support multiple separated stacks of fan-folded sheet stock material.

Figure 20:
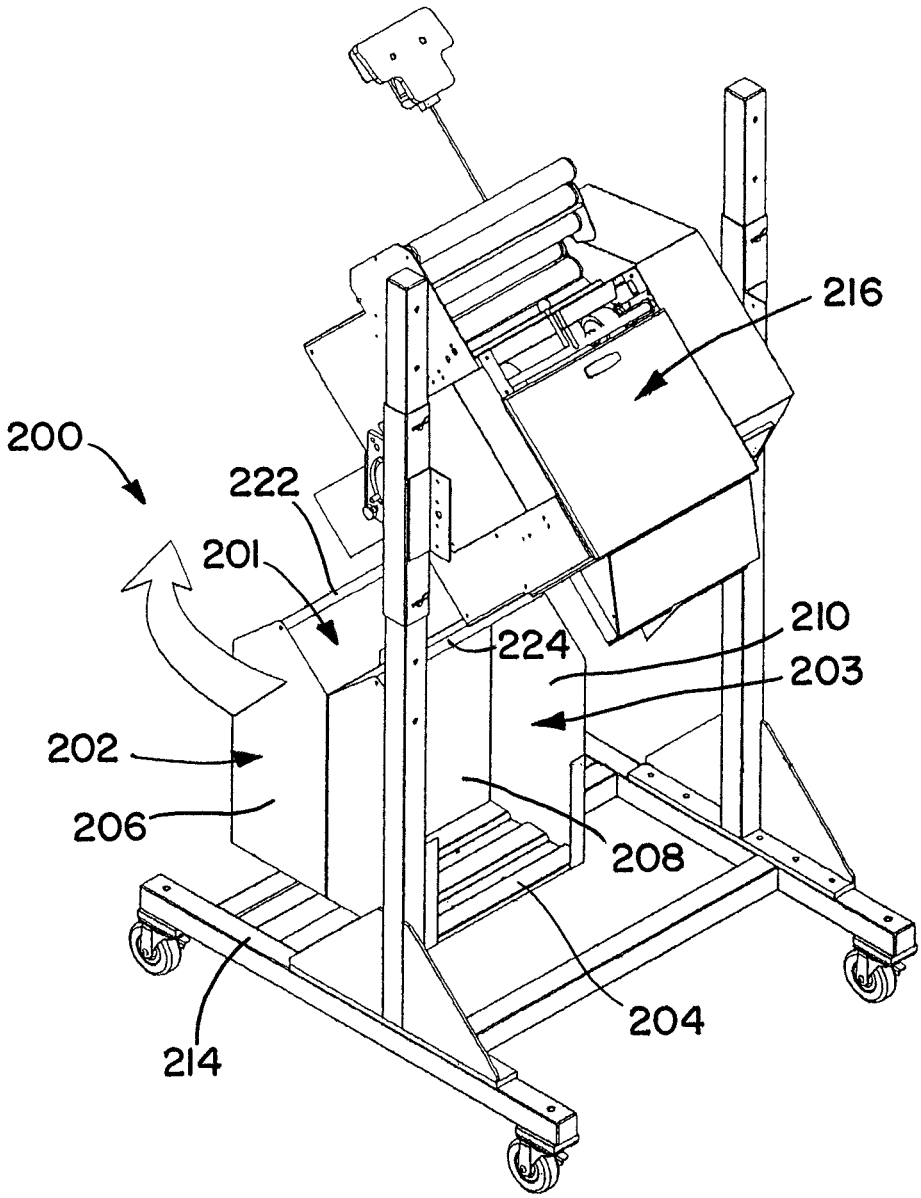
FIG. 20 is a perspective view of another stock supply provided in accordance with the present invention with a dunnage conversion machine.
Figure 21:
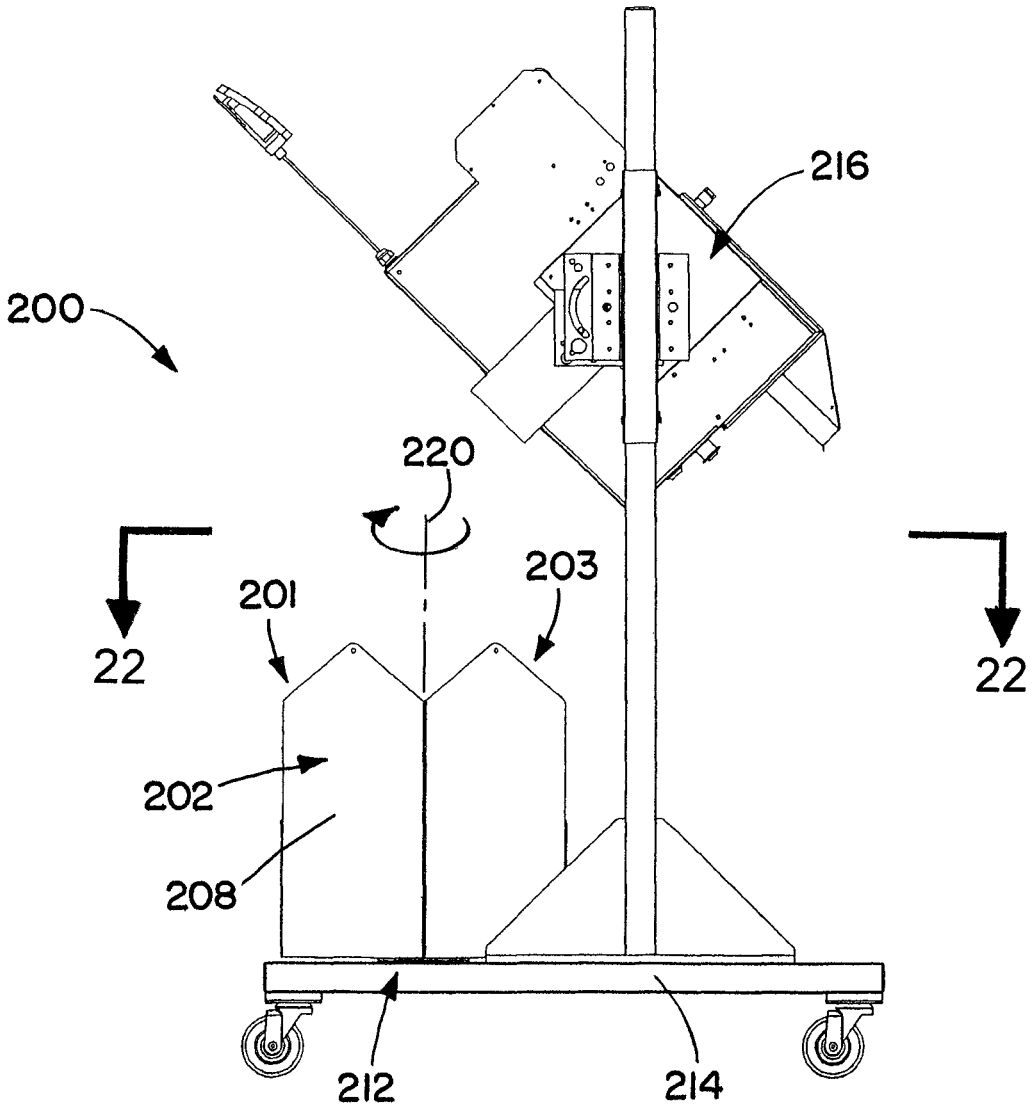
FIG. 21 is a side elevation view of the stock supply of FIG. 20.
Figure 22:
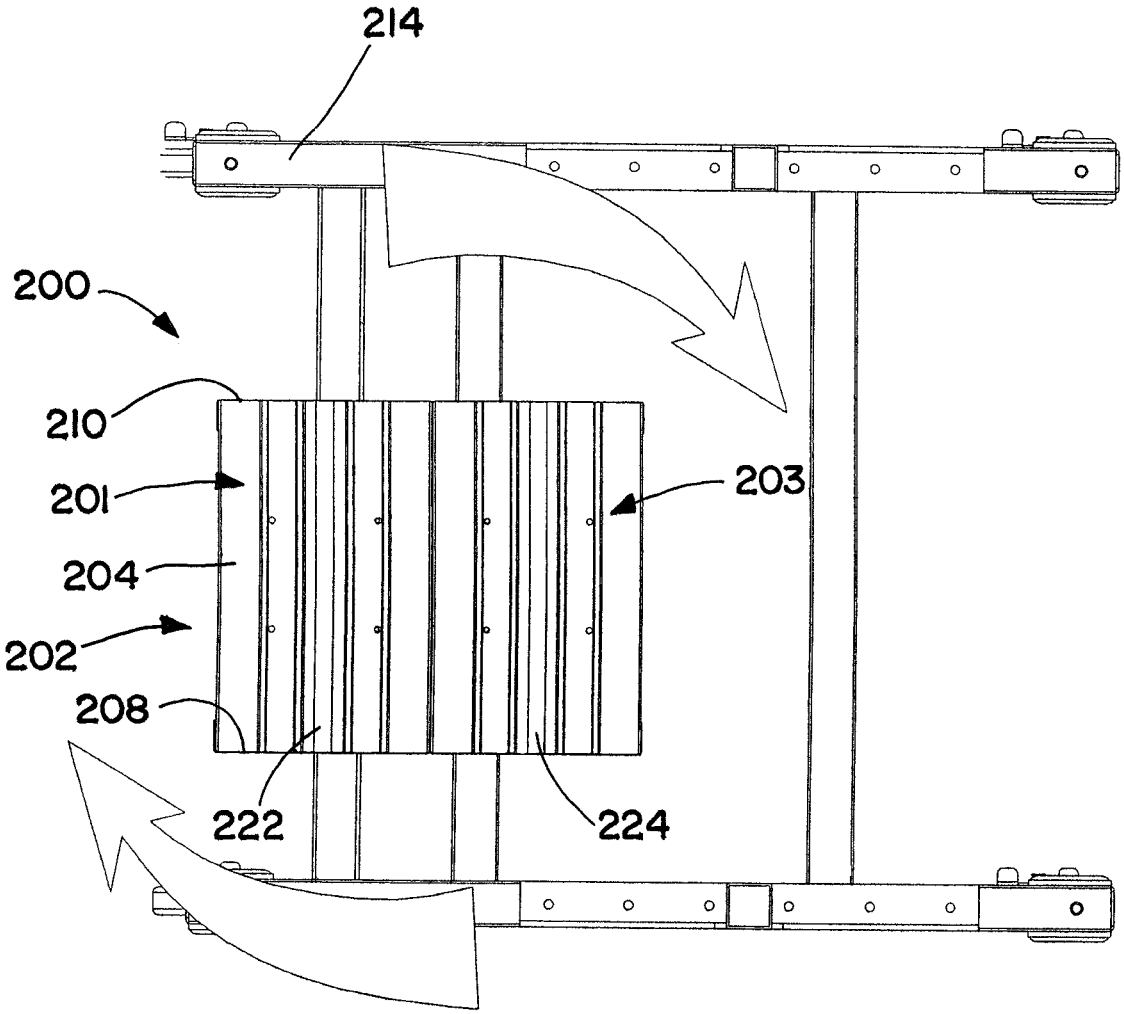
FIG. 22 is a cross-sectional view of the stock supply as seen along lines 22-22 of FIG. 21.

In FIGS. 20-22, for example, the stock supply 200 can support two stacks of fan-folded sheet stock material positioned back-to-back in horizontally-separated compartments 201 and 203. The stock supply 200 again includes a stand 202 with a base 204 and upright side walls 206, 208, and 210 that are arranged perpendicular to adjacent side walls and to the base to define the compartments 201 and 203 that support stacks of fan-folded sheet stock material. In this example, the base 204 of the stock supply 200 is supported by a turntable 212 mounted to the stand 214 for a dunnage conversion machine 216. Thus the stand 202 for the stock supply 200 can be rotated about a vertical axis 220 to provide access to either of the two compartments 201 and 203 that support the stacks of sheet material. The stock supply stand 202 also includes transverse guide members 222 and 224, typically including rollers, positioned toward a top of the side walls 206 and 210 to guide the sheet stock material pulled from each compartment to the conversion machine 216.

Figure 23:
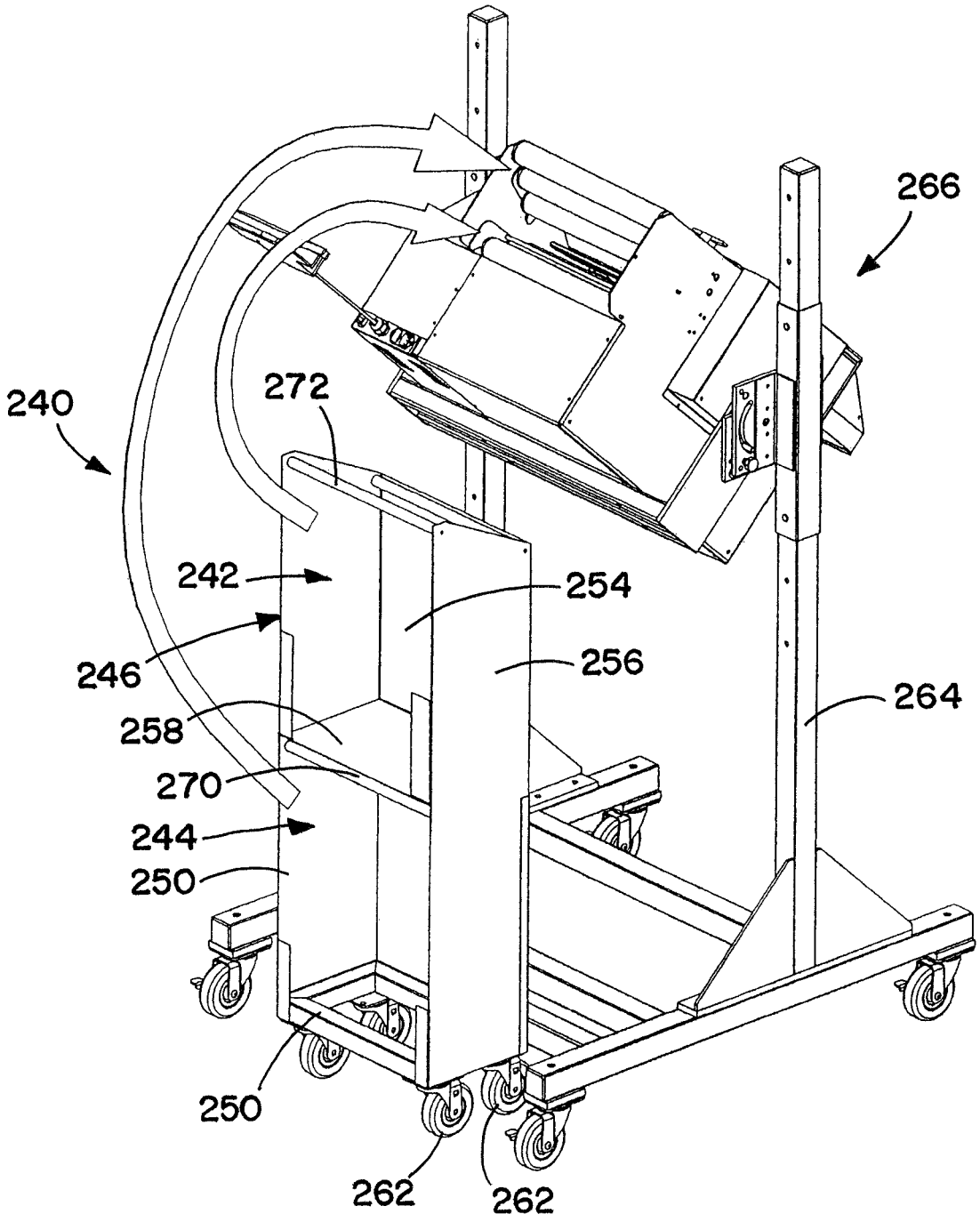
FIG. 23 is a perspective view of another stock supply provided in accordance with the present invention with a dunnage conversion machine.

In another embodiment, shown in FIG. 23, a stock supply 240 supports two or more stacks of fan-folded sheet stock material in vertically-separated compartments 242 and 244. The stock supply 240 includes a stand 246 with a base 250 and upright side walls 252, 254, and 256 that are arranged perpendicular to adjacent side walls and to the base. The stand 246 also includes a shelf 258 spaced from and parallel to the base 250, whereby the stand 246 can support a stack of fan-folded sheet stock material on each of the base 250 and the shelf 258. The side walls 252, 254, and 256; the base 250; and the shelf 258 cooperate to define the compartments 242 and 244 that support at least two stacks of fan-folded sheet stock material. Again, the stand 246 can include wheels 262 to form a cart and can be separate from or integral with a stand 264 for a conversion machine 266.

The stock supply stand 246 also includes transverse guide members 270 and 272, each of which can include a roller, to guide the sheet stock material pulled from each compartment 242 and 244. This vertical arrangement is more compact and takes up less floor space than two or more of the stock supply carts 70 shown in FIG. 1, for example, and thus is advantageous in many cases where multiple plies of sheet stock material are being fed to a conversion machine for conversion into a thicker and relatively less dense dunnage product.

Figure 24:
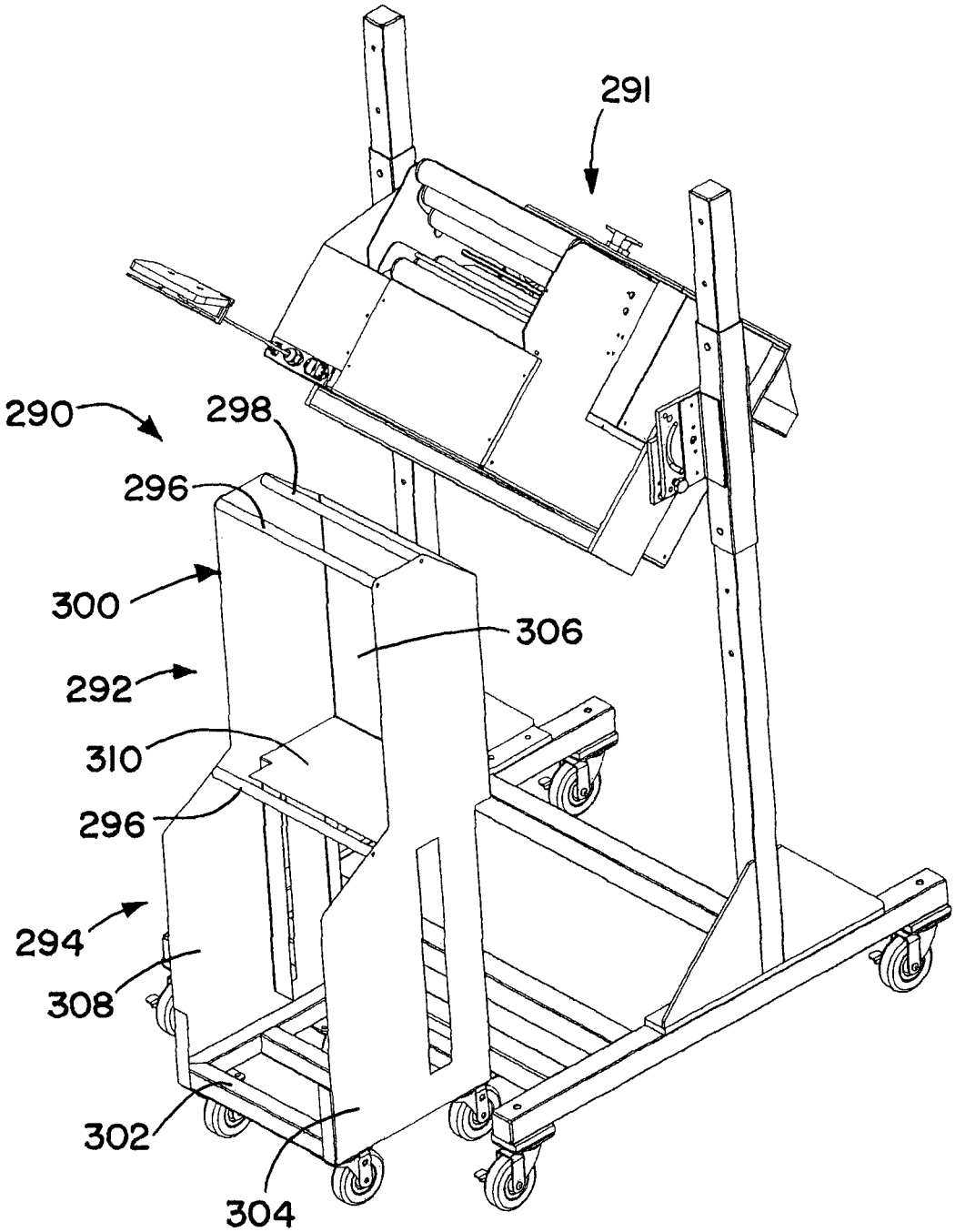
FIG. 24 is a perspective view of another stock supply provided in accordance with the present invention with a dunnage conversion machine.

An alternative stock supply 290 with two or more vertically-separated compartments is shown in FIG. 24. In this stock supply 290, upper compartments are horizontally stepped back from a front side of the next-lower compartment. This makes it easier to guide the sheet stock material to a conversion machine 291. In the illustrated embodiment, each of two compartments 292 and 294 includes a transverse guide member 296 toward a forward edge to guide sheet stock material from a compartment below that guide member. The top compartment 292 also includes a transverse guide member 298 spaced back from the front of the compartment to guide stock material pulled from that compartment. As in the other embodiments, the transverse guide members 296 and 298 typically include rollers.

In all other respects, the stock supply of FIG. 24 is similar to the stock supply of FIG. 23. Consequently, the stepped stock supply 290 includes a stand 300 with a base 302 and upright side walls 304, 306, and 308 that are arranged perpendicular to adjacent side walls and to the base. The stand 300 also includes a shelf 310 spaced from and parallel to the base 302, whereby the stand 300 can support a stack of fan-folded sheet stock material on each of the base 302 and the shelf 310. The side walls 304, 306, and 308; the base 302; and the shelf 310 cooperate to define the compartments 292 and 294 that support at least two stacks of fan-folded sheet stock material. If more than two compartments are desired, additional shelves can be provided to create additional upper-level compartments.

Thus, among other features the present invention provides a machine 50 (FIG. 1) includes a conversion assembly 54 for converting sheet stock material into a dunnage product as the sheet stock material travels along a path from an upstream end 72 of the conversion assembly 54 to a downstream end 74 of the conversion assembly 54. The machine 50 further includes a transversely extending guide 88 over which the stock material passes for guided entry into the upstream end 72 of the conversion assembly 54. The guide 88 is rotatable such that the transverse extent of the guide 88 can be moved between a plurality of relatively rotated orientations to guide the sheet stock material from different sides of the conversion assembly 54.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

In summary, the present invention provides one or more of the features described in the following clauses:

A. A machine for converting a sheet stock material into a dunnage product comprising: a conversion assembly to convert sheet stock material into a dunnage product as the sheet stock material travels along a path from an upstream end of the conversion assembly to a downstream end of the conversion assembly; and a transversely extending guide over which the stock material passes for guided entry into the upstream end of the conversion assembly, where the guide is rotatable such that the transverse extent of the guide can be relatively angularly oriented to guide the sheet stock material from different sides of the conversion assembly.

B. A machine as set forth in clause A or any other clause depending from clause A, where the guide is spaced from the upstream end of the conversion assembly by a frame that is movable with the guide as a unit.

C. A machine as set forth in clause A or any other clause depending from clause A, comprising a housing extending between an inlet near the guide and an outlet near an upstream end of the conversion assembly to minimize noise due to operation of the conversion assembly, and the housing and the guide are movable together as a unit.

D. A machine as set forth in clause A or any clause depending from clause A, where the conversion assembly includes a feed assembly having a movable device for drawing stock material through the conversion assembly along a longitudinal axis through the conversion assembly, and a forming assembly upstream of the feed assembly, the forming assembly being rotatable about the longitudinal axis independently of the feed assembly.

E. A machine as set forth in clause A or any other clause depending from clause A, where the conversion assembly includes a longitudinal axis, and the conversion assembly converts sheet stock material into a dunnage product as the stock material travels substantially along the longitudinal axis.

F. A machine as set forth in clause E or any other clause depending from clause E, where the longitudinal axis of the conversion assembly is vertical.

G. A machine as set forth in clause E or any other clause depending from clause E, where the guide is rotatable about the longitudinal axis of the conversion assembly.

H. A machine as set forth in clause E or any other clause depending from clause E, where the conversion assembly includes a chute that converges from an upstream end to a relatively smaller downstream end along the longitudinal axis of the conversion assembly.

I. A machine as set forth in clause A or any other clause, where the conversion assembly includes a movable device that moves stock material through the conversion assembly.

J. A machine as set forth in clause A or any other clause, comprising a linkage mechanism mounted to the conversion assembly that allows the conversion assembly to be moved relative to a support to which the linkage assembly is mountable without changing the orientation of the conversion assembly.

K. A dunnage conversion system, comprising a machine as set forth in clause A or any other clause, and a support for a supply of sheet stock material, where the support includes a horizontal support surface and a pair of laterally-spaced upright supports, at least one of the supports being laterally adjustable to accommodate different widths of stock material.

L. A system as set forth in clause K or any other clause depending from clause K, where the support is movable relative to the machine to supply stock material from a plurality of different positions.

M. A dunnage conversion machine, comprising a conversion assembly for converting stock material into a dunnage product as the stock material travels from an upstream end of the conversion assembly to a downstream end of the conversion assembly; and a linkage mechanism to which the conversion assembly is mounted to support and guide the conversion assembly for translating movement relative to a support to which the linkage mechanism is mountable, whereby the conversion assembly is movable between a non-operating position and an operating position without changing the orientation of the conversion assembly.

N. A machine as set forth in clause M or any clause that depends from clause M, where the linkage mechanism provides for translating movement of the conversion assembly without rotating the conversion assembly about a generally horizontal axis.

O. A machine as set forth in clause M or any clause that depends from clause M, where the linkage mechanism provides for translating movement simultaneously horizontally and vertically without rotating the conversion assembly about a generally horizontal axis.

P. A machine as set forth in clause M or any clause that depends from clause M, where the linkage mechanism includes a four-bar linkage where one bar is formed by the conversion assembly and another bar is formed by the support.

Q. A device for supporting a stack of sheet stock material for conversion into a dunnage product, comprising a generally horizontal support surface and a pair of laterally-spaced upright support members, at least one of the support members being laterally adjustable relative to the other support member to provide lateral support for different widths of stock material.

R. A device as set forth in clause Q or any other clause that depends from clause Q, comprising transverse guides perpendicular to the laterally-spaced support members to guide sheet stock material pulled from the support surface.

S. A device as set forth in clause Q or any other clause that depends from clause Q, where each support member includes parallel front and rear support faces that extend toward the opposing support member to support front and rear surfaces of a stack of sheet stock material.

T. A device for supporting multiple stacks of sheet stock material for conversion into a dunnage product, comprising at least two generally horizontal support surfaces, including at least one base support surface, and at least three upright walls extending from the at least one base support surface, whereby the support surfaces and the upright walls cooperate to define at least two compartments for supporting respective stacks of sheet stock material.

U. A device as set forth in clause S or any other clause depending from clause S, where the at least two support surfaces include two base support surfaces that cooperate with the upright walls to define at least two compartments, where the compartments are horizontally spaced relative to one another.

V. A device as set forth in clause S or any other clause depending from clause S, where the at least two support surfaces include the at least one base support surface and at least one shelf support surface at an elevated position relative to at least one of the base support surfaces and thereby cooperates with the upright walls to define at least two compartments, where the compartments are vertically spaced relative to one another.

We claim:

1. A device for supporting a rectangular stack of fan-fold sheet stock material for conversion into a dunnage product, comprising a generally horizontal support surface, at least one stationary upright side wall fixed in position relative to the support surface, and a pair of parallel, laterally-spaced upright support members extending in a common direction relative to the support surface, at least one of the support members being laterally adjustable relative to the other support member to provide lateral support for different widths of stock material, and an upright back wall with a slot for receiving an extension of the laterally-adjustable support member to guide lateral movement of the support member, wherein the upright support members are perpendicular to the horizontal support surface and perpendicular to the back wall, and wherein the device is configured to be coupled to a dunnage conversion machine.

2. A device as set forth in claim 1, comprising transverse guides perpendicular to the laterally-spaced support members to guide sheet stock material pulled from the support surface.

3. A device as set forth in claim 2, where the transverse guides are supported above the laterally-adjustable support member.

4. A device as set forth in claim 3, wherein the at least one stationary side wall extends above the laterally-adjustable support member to support the transverse guides.

5. A device as set forth in claim 4, comprising a pair of side walls positioned outside the laterally-adjustable support member, that extend above the laterally-adjustable support member to support the transverse guides, and are fixed in position relative to the support surface.

6. A device as set forth in claim 1, where each support member includes parallel front and rear support faces that extend toward the opposing support member to support front and rear surfaces of a stack of sheet stock material.

7. A device as set forth in claim 1, where the pair of laterally-spaced upright support members are both laterally adjustable relative to the other support member to provide lateral support for different widths of stock material.

8. A device as set forth in claim 1, further comprising one or more wheels connected to the support surface to facilitate moving the device.

9. A device as set forth in claim 1, comprising a stand for supporting a stack of sheet stock material for conversion into a dunnage product, the stand including:

a base support member that defines the horizontal support surface; and a pair of laterally-spaced, stationary upright side walls extending perpendicularly from the base support member at respective opposing ends of the base support member;

wherein the pair of laterally-spaced upright support members extend perpendicularly from the base support member respectively adjacent to and between the pair of laterally-spaced, stationary upright side walls.

10. The stand as set forth in claim 9, further comprising a transverse guide member supported by and extending between respective upper ends of the pair of laterally-spaced, stationary upright side walls, above respective upper ends of the pair of laterally-spaced upright support members such that the at least one of the pair of laterally-spaced upright support members is laterally-adjustable underneath the transverse guide member.

11. The stand as set forth in claim 9, wherein the upright back wall includes at least one transverse slot parallel to the base support member into which at least one extension of the at least one of the pair of laterally-spaced upright support members that is laterally-adjustable extends to support the at least one of the pair of laterally-spaced upright support members as it laterally adjusts relative to the other of the pair of laterally-spaced upright support members.

12. The stand as set forth in claim 9, wherein each of the pair of laterally-spaced upright support members include an inwardly-extending front support wall extending perpendicularly from each of the pair of laterally-spaced upright support members toward the other of the pair of laterally-spaced upright support members.

13. The stand as set forth in claim 9, further comprising one or more wheels connected to the base support member.

14. The stand as set forth in claim 9, wherein both of the pair of laterally-spaced upright support members are laterally-adjustable relative to each other to accommodate and support lateral sides of the stack of sheet stock material.

* * * * *